US011604042B1

(12) United States Patent
Paulson

(10) Patent No.: US 11,604,042 B1
(45) Date of Patent: Mar. 14, 2023

(54) SILENCER FOR MULTI BARREL WEAPON SYSTEMS

(71) Applicant: Kristopher Lee Paulson, Hendersonville, TN (US)

(72) Inventor: Kristopher Lee Paulson, Hendersonville, TN (US)

( * ) Notice: Subject to any disclaimer, the term of this patent is extended or adjusted under 35 U.S.C. 154(b) by 0 days.

(21) Appl. No.: 17/829,544

(22) Filed: Jun. 1, 2022

Related U.S. Application Data

(60) Provisional application No. 63/256,247, filed on Oct. 15, 2021.

(51) Int. Cl.
*F41A 21/30* (2006.01)
*F41A 21/48* (2006.01)
*F41A 21/06* (2006.01)

(52) U.S. Cl.
CPC ..... *F41A 21/30* (2013.01); *F41A 21/06* (2013.01); *F41A 21/48* (2013.01)

(58) Field of Classification Search
CPC ..... F41A 21/06; F41A 21/30; F41A 21/48
See application file for complete search history.

(56) References Cited

U.S. PATENT DOCUMENTS 9,791,241 B2 * 10/2017 Rowe ..... F41A 21/487
2019/0186859 A1 * 6/2019 Sautmann ..... F41A 21/30

FOREIGN PATENT DOCUMENTS

CN 113310346 A * 8/2021

OTHER PUBLICATIONS

English translation of CN-113310346-A, accessed Jan. 24, 2023 through USPTO Search tool. (Year: 2021).*
Image of "Minigun suppressed;" DeGroat Tachtical Armaments, LLC; accessed via Google search; <https://americasbestpics.com/picture/minigun-suppressed-degroat-tactical-armaments-llc-www-armamentsales-com-ff-sZtQJPHr8?s=cl> (Year: 2021).*
Luke C; "Quiet Times Eight! Liberty Suppressors Develops Gatling Gun Suppressor"; Dec. 30, 2020; The Firearm Blog; (Year: 2020).*

* cited by examiner

*Primary Examiner* — Jeremy A Luks
(74) *Attorney, Agent, or Firm* — Eric B. Fugett; Mark A. Pitchford; Pitchford Fugett, PLLC

(57) ABSTRACT

A suppressor for a multi-barrel weapon system includes a barrel clamp about which the barrels rotate during discharge of the weapon, an adapter baffle engaging the barrel clamp and configured to receive the muzzles of the barrels, a plurality of extension baffles aligned with and arranged in a stack against the adaptor baffle, and an endcap baffle aligned with the extension baffles and engaging the final extension baffle in the stack. A plurality of projectile apertures in each baffle aligns with the muzzles to define a plurality of parallel bullet paths. The stacked baffles define a single continuous interior chamber in which the muzzles are enclosed and through which propellant gases comingle before venting out of the endcap baffle. A connecting rod extends through the barrel clamp and the baffle stack to compressively secure the baffle stack to the barrel clamp.

27 Claims, 30 Drawing Sheets

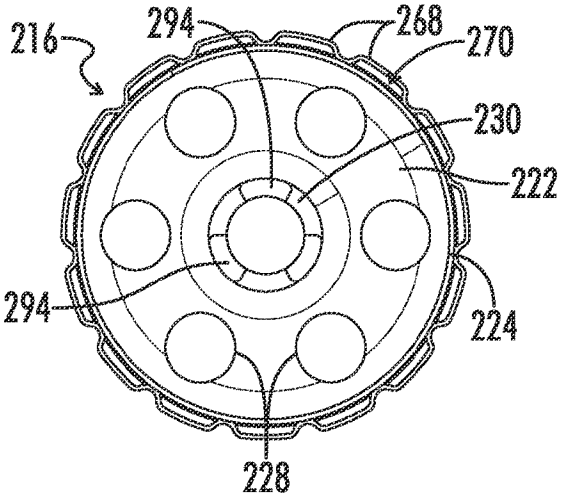
FIG. 22A
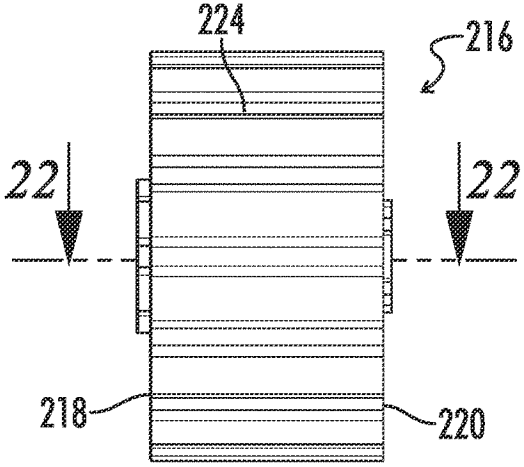
FIG. 22B
FIG. 22C
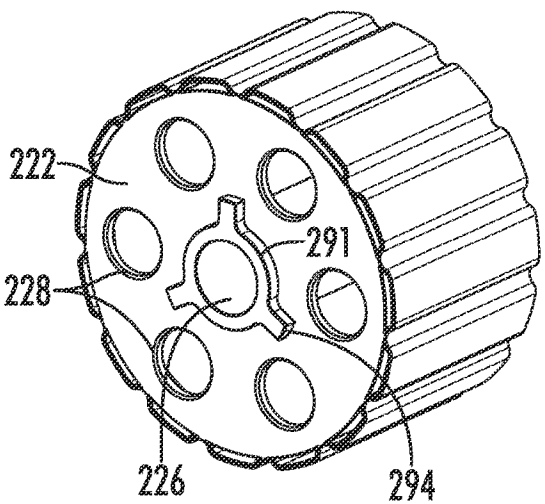
FIG. 22D
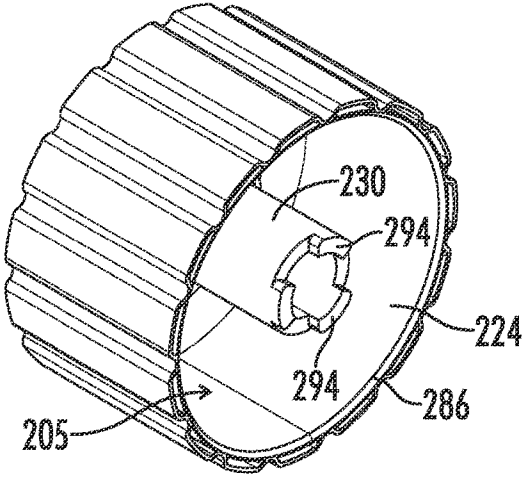
FIG. 22E
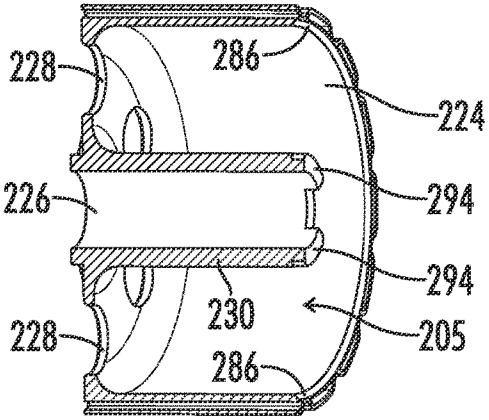
FIG. 22F

SILENCER FOR MULTI BARREL WEAPON SYSTEMS

CROSS-REFERENCES TO RELATED APPLICATIONS

This non-provisional patent application claims priority to U.S. Provisional Patent Application Ser. No. 63/256,247, filed Oct. 15, 2021 and titled "SILENCER FOR MULTI BARREL WEAPON SYSTEMS," the entire disclosure of which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND OF THE INVENTION

The present invention relates generally to the field of firearms, and more particularly, to flash and sound suppressors for firearms.

A rotary machine gun is an externally powered weapon system consisting of multiple barrels arranged to rotate about the central longitudinal axis of a rotor while discharging ammunition at a high rate of fire. The firing sequence occurs at a fixed point of the rotation resulting in each barrel discharging once per complete revolution. An example is the M134 Minigun, a six-barrel electrically driven rotary machine gun. A conventional minigun or other rotary machine gun uses a barrel clamp that supports the multi-barrel cluster distally from the rotor. Some known barrel clamp designs have a hollow central shaft along which are affixed several disk-shaped supports and a shallow cup with a cross-bolt. The barrel cluster passes through the supports in order to maintain the barrel cluster's rigidity and reduce vibration while rotating at high speed. The shallow cup with cross-bolt sits on a group of lugs on the barrel cluster. The cross bolt extends through holes in the sides of the cup and between the barrels behind the barrel lugs, thereby securing the barrel clamp to the barrel cluster and preventing forward and aft slippage of the assembly. Other known barrel clamp designs include a single disk-shaped support on the forward end of the clamp with a hollow open cylinder extending from the perimeter of the support forward of the muzzles of the barrel cluster as a flash mitigation device or "Flash Hider." Most current barrel clamp designs attempt to hide the flash, but often with limited or minimal effect.

In addition, current rotary multi-barrel machine guns lack sound suppressors that substantially reduce the report (that is, the sound volume) of the firing sequence. Conventional silencers or sound suppressors for handguns and shoulder fired long guns are typically designed as thread-on muzzle devices, that is, they are designed to screw (i.e., thread) onto a short section of complimentary threads formed at the muzzle end of the barrel of the firearm. Conventional suppressors typically consist of a tube containing a stack of flat, slanted or conically shaped baffles. The baffle stack has a single concentric bore space through the center that aligns with the muzzle of the weapon. Each projectile fired from the weapon travels unimpeded through the bore space while the rapidly expanding propellant gases behind it are trapped and retarded by the baffle stack thus mitigating the report associated with an unsuppressed firearm.

The multi-barreled rotary machine gun configuration presents unique challenges to the use of individual suppressors. The geometry of the multi-barrel configuration creates size constraints making the use of appropriately sized individual suppressors for each barrel impractical for a weapon system capable of sustained high rates of fire. Additionally, due to the high volume of fire associated with the M134 weapon system, barrels are considered a consumable item requiring frequent replacement. Adapting the currently fielded barrel to an individually threaded suppressor design would require an entirely new and costly barrel design.

The excessive flash and report produced by the current M134 weapon system creates significant tactical deficiencies. No barrel clamp currently in use in the field has been effective in mitigating the substantial flash or fireball produced by the M134 Minigun. The aforementioned fireball produced by the minigun allows enemy combatants to easily visually identify and target the weapon system and its platform. The flash signature also degrades the natural night vision and limits the performance of image intensifying devices or night vision devices employed by the operator. Additionally, the distinctive report created by the unsuppressed Minigun can be heard at great distances alerting opposing forces not directly engaged of its presence.

What is needed, then, are new flash and sound suppression designs for multi-barrel weapon systems such as a rotary machine gun.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Features of the presently disclosed invention overcome or minimize some or all of the identified deficiencies of the prior art, as will become evident to those of ordinary skill in the art after a study of the information presented in this document.

The present invention provides a flash and sound suppressor for a multi barreled weapon system such as a rotary machine gun having a plurality of barrels. The suppressor includes a plurality of differently configured, modular baffles arranged in a stack and compressively secured by a connecting rod to a barrel clamp on which the plurality of barrels are supported. Each baffle defines an interior space in fluid communication with the internal space of every other baffle such that the assembled baffle stack defines a single continuous interior chamber in which the muzzles of the barrels are enclosed and through which propellant gases emitted from the muzzle of each barrel comingle and circulate before venting to the atmosphere. When mounted to the plurality of barrels via the barrel clamp, the assembled suppressor rotates with the barrel clamp and plurality of barrels during discharge of the weapon.

Accordingly, one aspect of the present invention provides a suppressor for a rotary machine gun having a plurality of barrels, the suppressor comprising a barrel clamp configured to support the plurality of barrels, the barrel clamp defining a central axis about which the plurality of barrels rotates with the barrel clamp during discharge of the machine gun when the plurality of barrels is supported by the barrel clamp; an adapter baffle engaging the barrel clamp and configured to receive a muzzle of each barrel of the plurality of barrels when the plurality of barrels is supported by the barrel clamp; a plurality of extension baffles aligned with and arranged in a stack on the adaptor baffle, each extension baffle comprising a plate, a sidewall extending from the plate, and a plurality of projectile apertures defined through the plate, wherein the plurality of projectile apertures of each extension baffle are configured to align with the plurality of projectile apertures of each adjacent extension baffle and the plurality of barrels when the muzzles are received in the adapter baffle; and an endcap baffle aligned with the plurality of extension baffles and engaging a final extension baffle of the stack, the endcap baffle comprising a plate through which is defined a plurality of projectile apertures that are aligned with the plurality of projectile apertures of each extension baffle.

In another aspect, the invention provides a suppressor for a rotary machine gun having a plurality of barrels supported by a barrel clamp that defines a central axis about which the plurality of barrels and the barrel clamp rotate during discharge of the machine gun, the suppressor comprising an adapter baffle configured to engage the barrel clamp and receive a muzzle of each barrel of the plurality of barrels when the adapter baffle is engaged with the barrel clamp; at least one extension baffle configured to engage the adapter baffle such that the extension baffle is aligned with the adapter baffle, the extension baffle comprising a sidewall and a plate through which is defined a plurality of projectile apertures that are configured to align with the plurality of barrels when the extension baffle is engaged with the adapter baffle and the adapter baffle is engaged with the barrel clamp; and an endcap baffle configured to engage the extension baffle such that the endcap baffle is aligned with the extension baffle, the endcap baffle comprising a plate through which is defined a plurality of projectile apertures that are configured to align with the plurality of projectile apertures in the extension baffle when the endcap baffle is engaged with the extension baffle. The adapter baffle, the extension baffle, and the endcap baffle can be configured to receive the connecting rod therethrough. The connecting rod can be configured to compressively secure the adapter baffle, the extension baffle, and the endcap baffle to the barrel clamp with the adapter baffle engaging the barrel clamp, the extension baffle engaging the adapter baffle, and the endcap baffle engaging the extension baffle.

In another aspect, the invention provides a suppressed rotary machine gun, comprising a rotor; a plurality of barrels connected to the rotor, each barrel of the plurality having a muzzle; a barrel clamp secured to the plurality of barrels and defining a central axis about which the barrel clamp rotates with the plurality of barrels during discharge of the rotary machine gun; an adapter baffle engaging the barrel clamp and configured to surround the muzzle of each barrel of the plurality of barrels, the adapter baffle comprising a plate through which is defined a plurality of barrel apertures in which the plurality of barrels is received; an aft extension baffle engaging and aligned with the adapter baffle, the extension baffle comprising a sidewall and a plate through which is defined a plurality of projectile apertures aligned with the plurality of barrels; a forward extension baffle engaging and aligned with the aft extension baffle, the forward extension baffle comprising a sidewall and a plate through which is defined a plurality of projectile apertures aligned with the plurality of projectile apertures in the aft extension baffle; and an endcap baffle engaging and aligned with the forward extension baffle, the endcap baffle comprising a plate through which is defined a plurality of projectile apertures aligned with the plurality of projectile apertures in the forward extension baffle; wherein the adaptor baffle, the aft extension baffle, the forward extension baffle, and the endcap baffle collectively define a single continuous interior chamber in which propellant gases emitted from the muzzle of each barrel of the plurality of barrels comingle and circulate before venting to the atmosphere through the endcap baffle.

Numerous other objects, advantages and features of the present disclosure will be readily apparent to those of skill in the art upon a review of the following drawings and description of exemplary embodiments.

BRIEF DESCRIPTION OF THE SEVERAL VIEWS OF THE DRAWINGS

Non-limiting and non-exhaustive embodiments are described with reference to the following figures, wherein like reference numerals refer to like parts throughout the various drawings unless otherwise specified. In the drawings, not all reference numbers are included in each drawing, for the sake of clarity.

FIG. 22A is a rear elevational view of the adapter baffle of the suppressor of FIG. 11B.

FIG. 22B is a right-side elevational view of the adapter baffle of FIG. 22A, the other side being a mirror image thereof.

FIG. 22C is a front elevational view of the adapter baffle of FIG. 22A.

FIG. 22D is an elevated rear isometric view of the adapter baffle of FIG. 22A.

FIG. 22E is an elevated front isometric view of the adapter baffle of FIG. 22A.

FIG. 22F is a front isometric sectional view taken along line 22-22 of FIG. 22B.

DETAILED DESCRIPTION

Figure 1A:
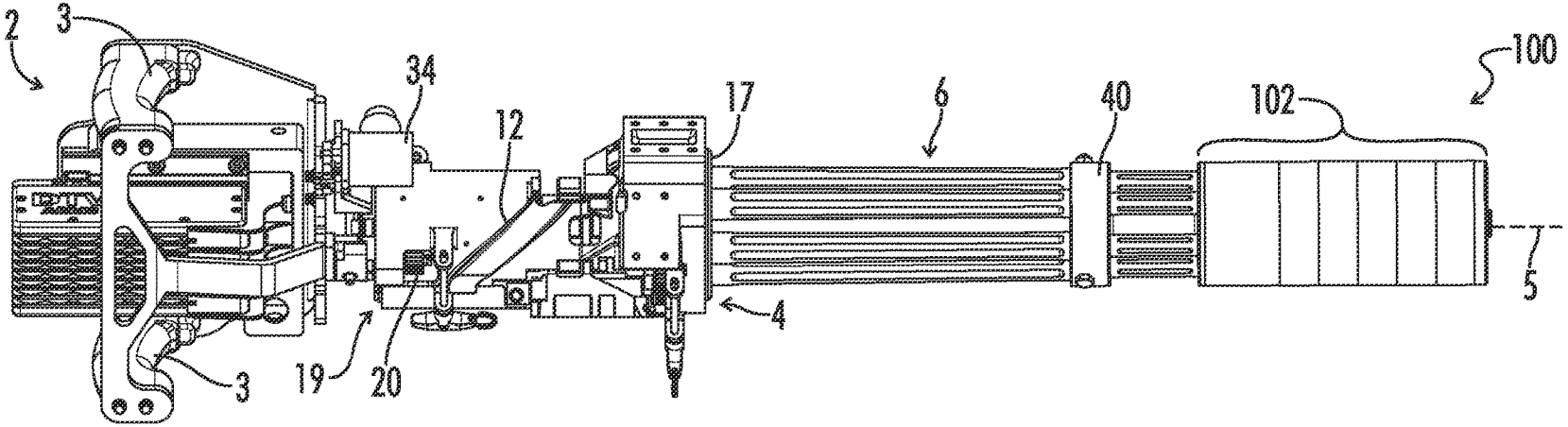
FIG. 1A is a bottom right side isometric view of an M134 rotary machine gun with a suppressor constructed in accordance with an embodiment of the present invention mounted thereon.
Figure 1B:
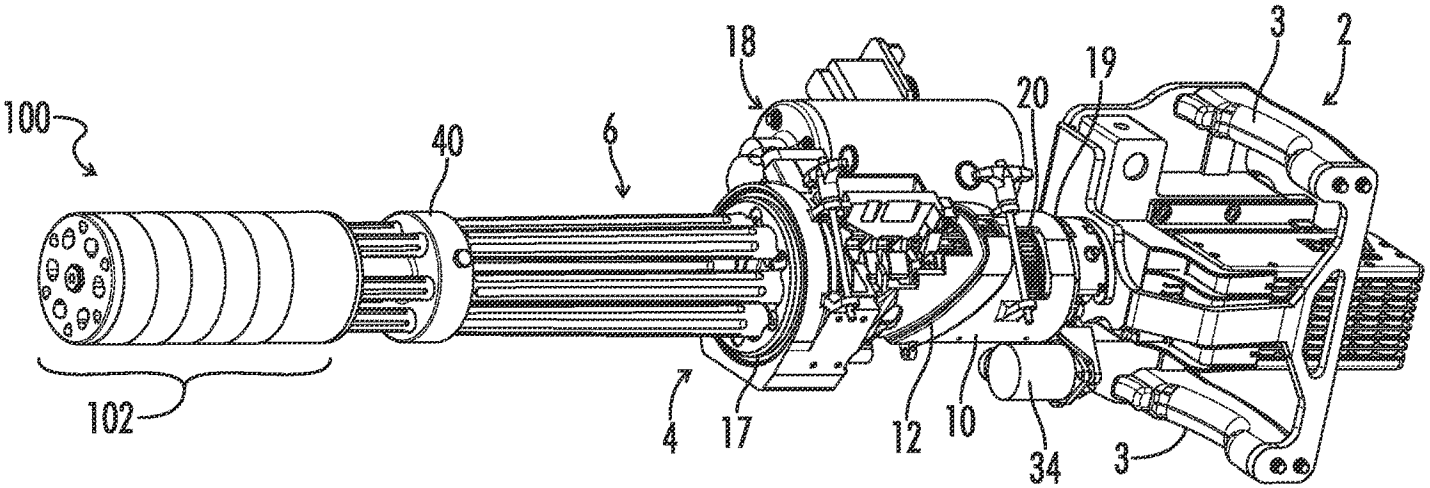
FIG. 1B is another isometric view of the objects of FIG. 1A from the bottom left side thereof.
Figure 1C:
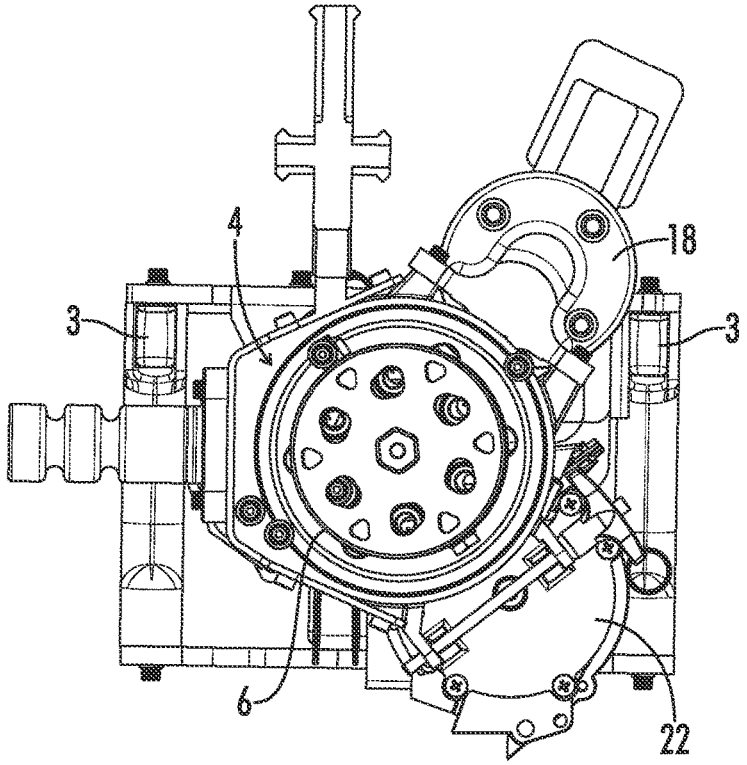
FIG. 1C is a front elevational view of the objects of FIG. 1A.
Figure 1D:
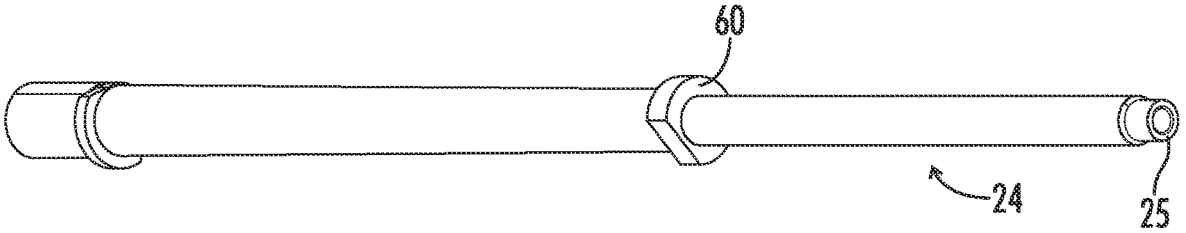
FIG. 1D is an isometric view of a single barrel of the rotary machine gun of FIG. 1A shown in isolation. The remaining five barrels forming the barrel cluster are identical.
Figure 2C:
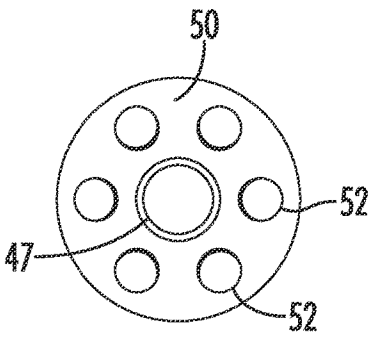
FIG. 2C is a front elevational view of the barrel clamp of FIG. 2A.
Figure 2A:
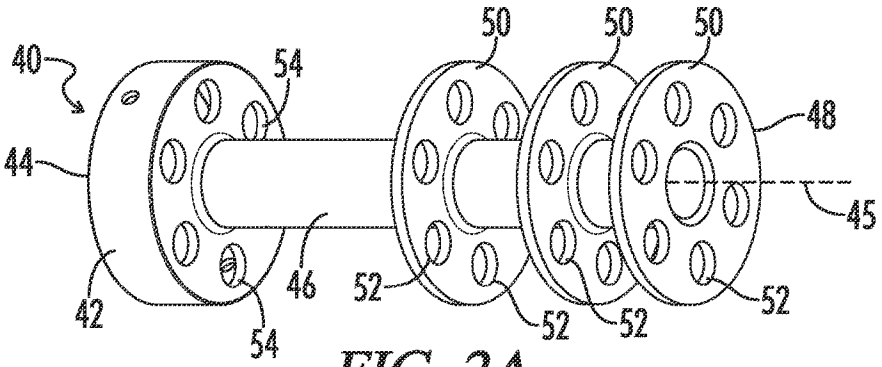
FIG. 2A is a front isometric view of an embodiment of a barrel clamp for the rotary machine gun of FIG. 1A.
Figure 2B:
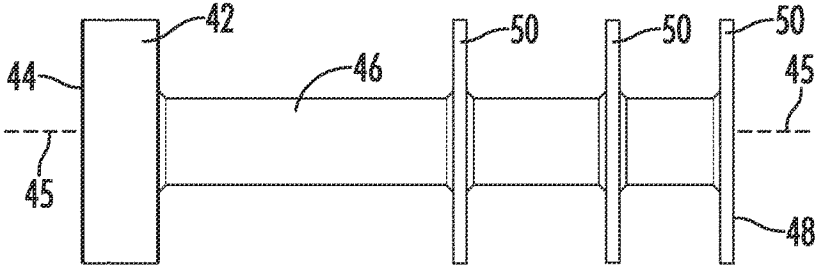
FIG. 2B is a side elevational view of the barrel clamp of FIG. 2A.
Figure 2D:
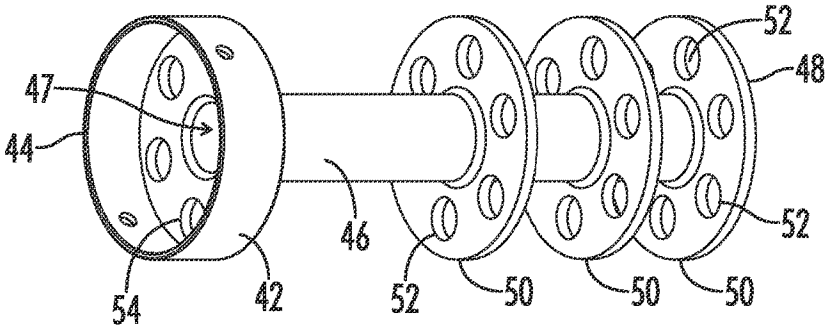
FIG. 2D is a rear isometric view of the barrel clamp of FIG. 2A.
Figure 3C:
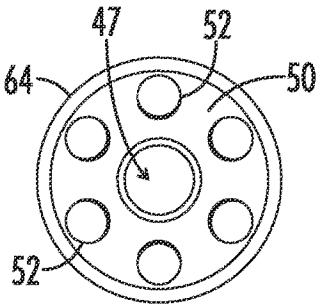
FIG. 3C is a front elevational view of the barrel clamp of FIG. 3A.
Figure 3A:
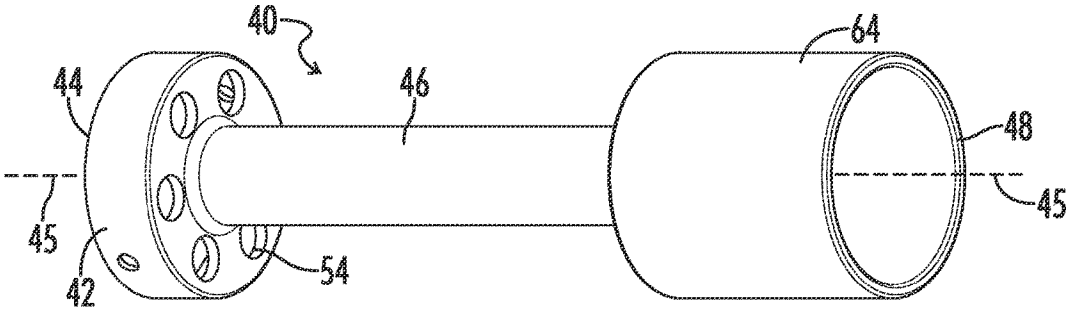
FIG. 3A is a front isometric view of another embodiment of a barrel clamp for the rotary machine gun of FIG. 1A.
Figure 3B:
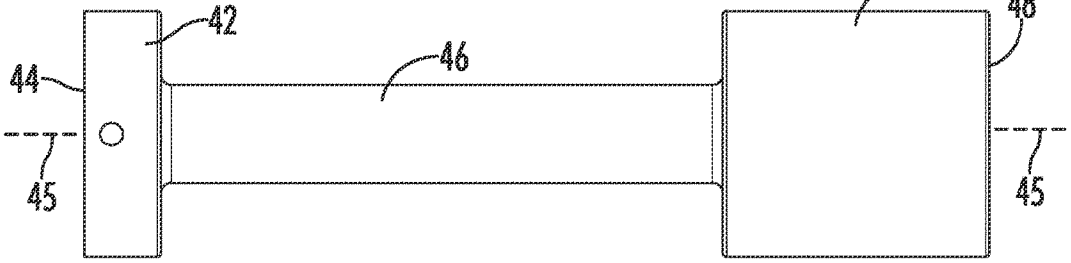
FIG. 3B is a side elevational view of the barrel clamp of FIG. 3A.
Figure 3D:
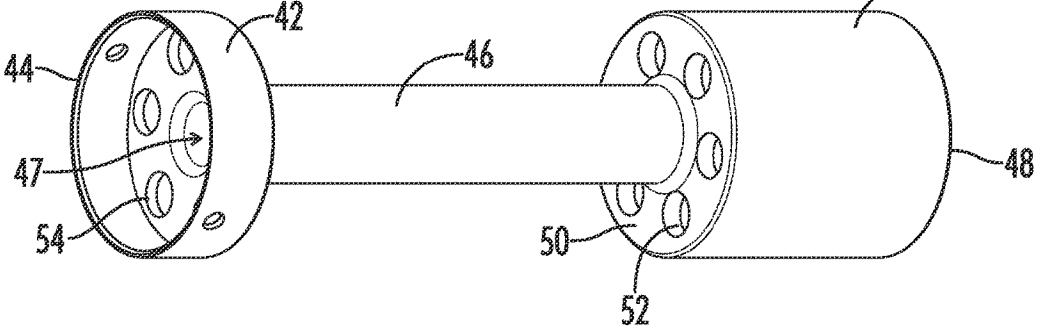
FIG. 3D is a rear isometric view of the barrel clamp of FIG. 3A.
Figure 4C:
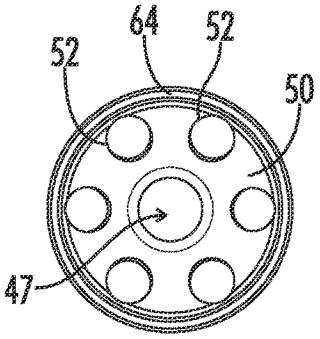
FIG. 4C is a front elevational view of the barrel clamp of FIG. 4A.
Figure 4A:
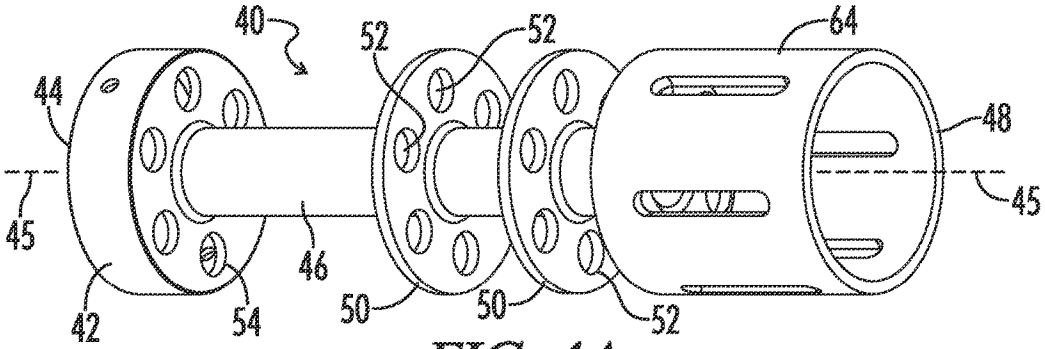
FIG. 4A is a front isometric view of yet another embodiment of a barrel clamp for the rotary machine gun of FIG. 1A.
Figure 4B:
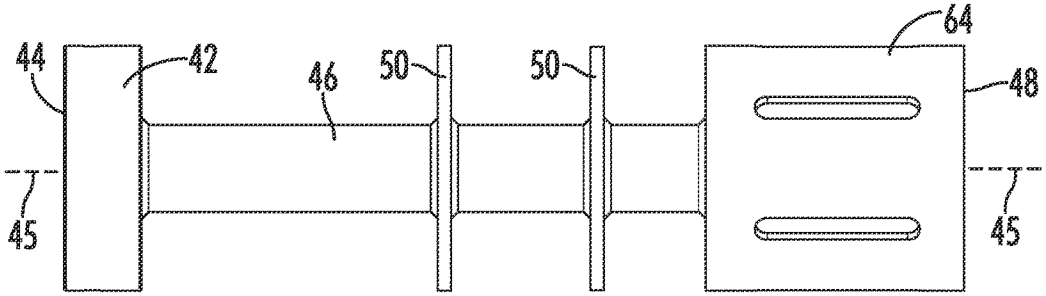
FIG. 4B is a side elevational view of the barrel clamp of FIG. 4A.
Figure 4D:
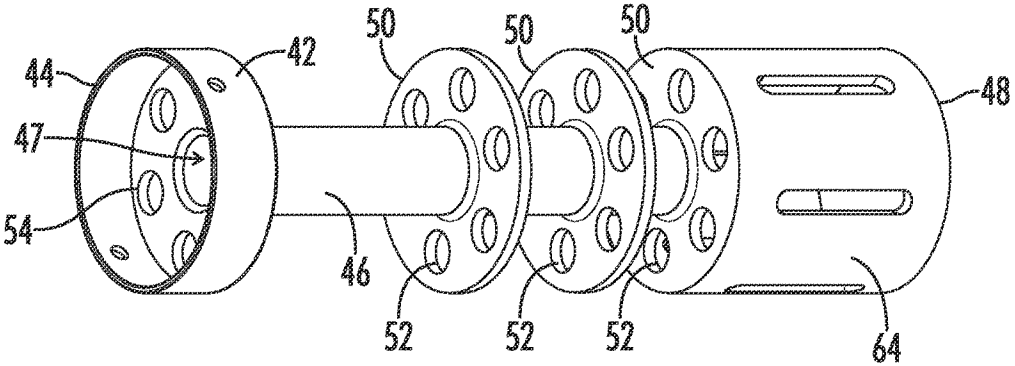
FIG. 4D is a rear isometric view of the barrel clamp of FIG. 4A.
Figure 5A:
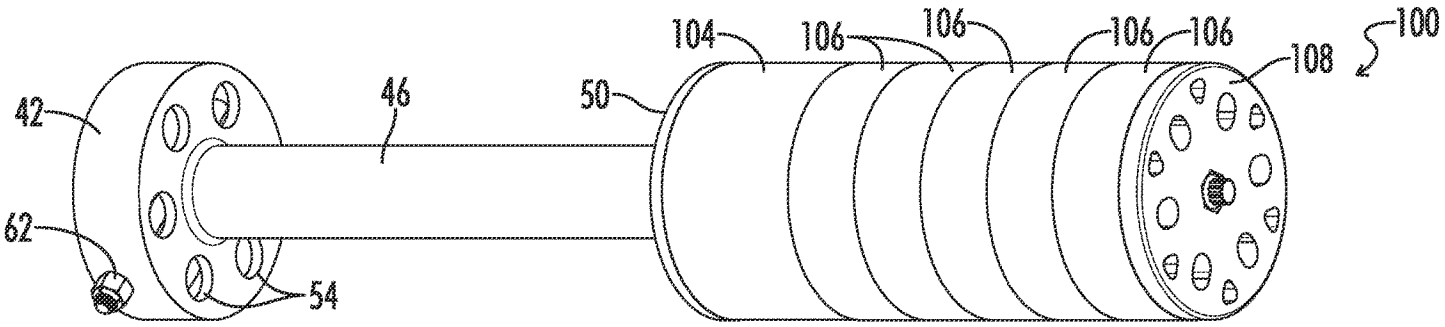
FIG. 5A is a front isometric view of the suppressor of FIG. 1A.
Figure 5B:
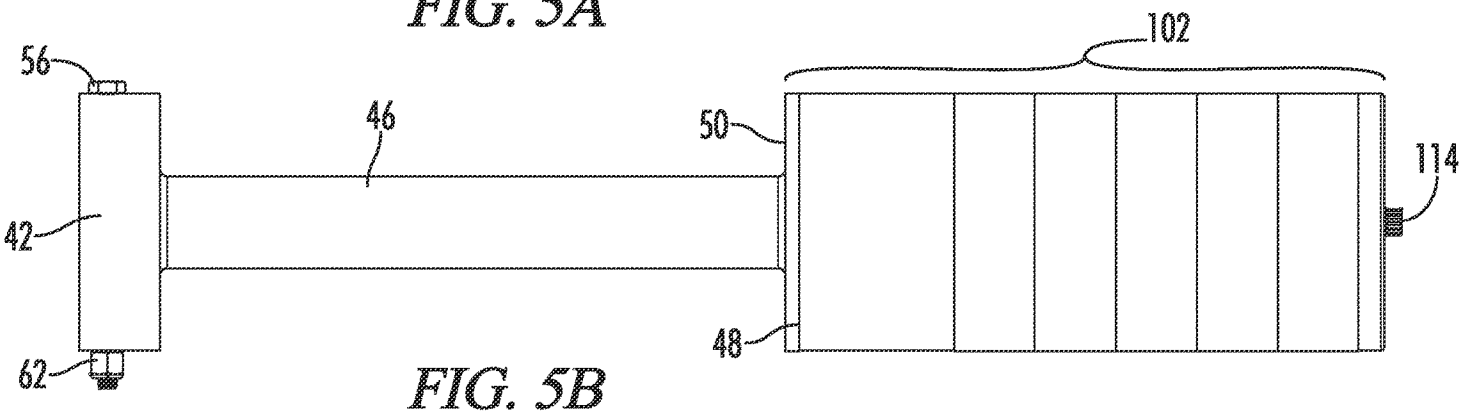
FIG. 5B is a side elevational view of the suppressor of FIG. 5A, the other side being a mirror image thereof.
Figure 5C:
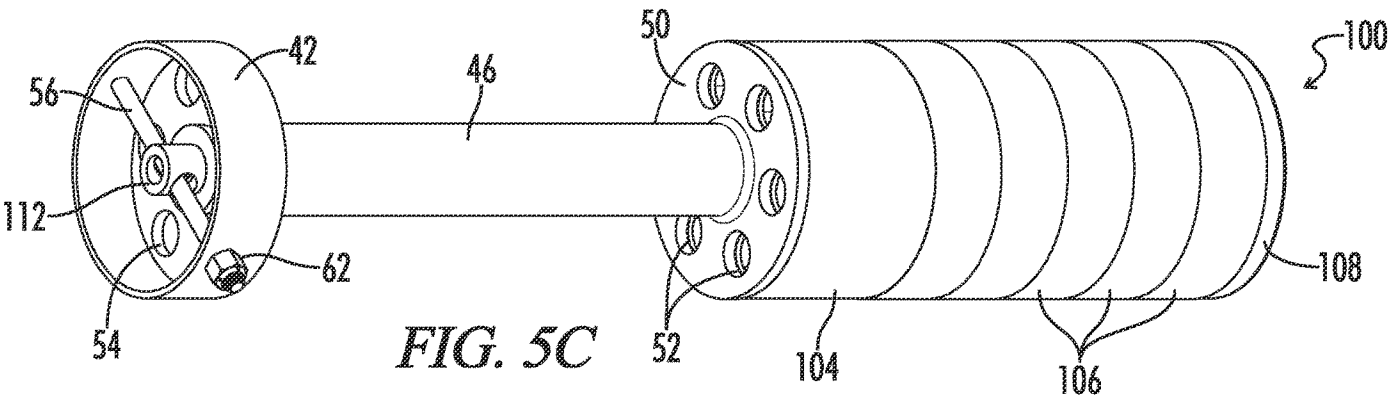
FIG. 5C is a rear isometric view of the suppressor of FIG. 5A.
Figure 6A:
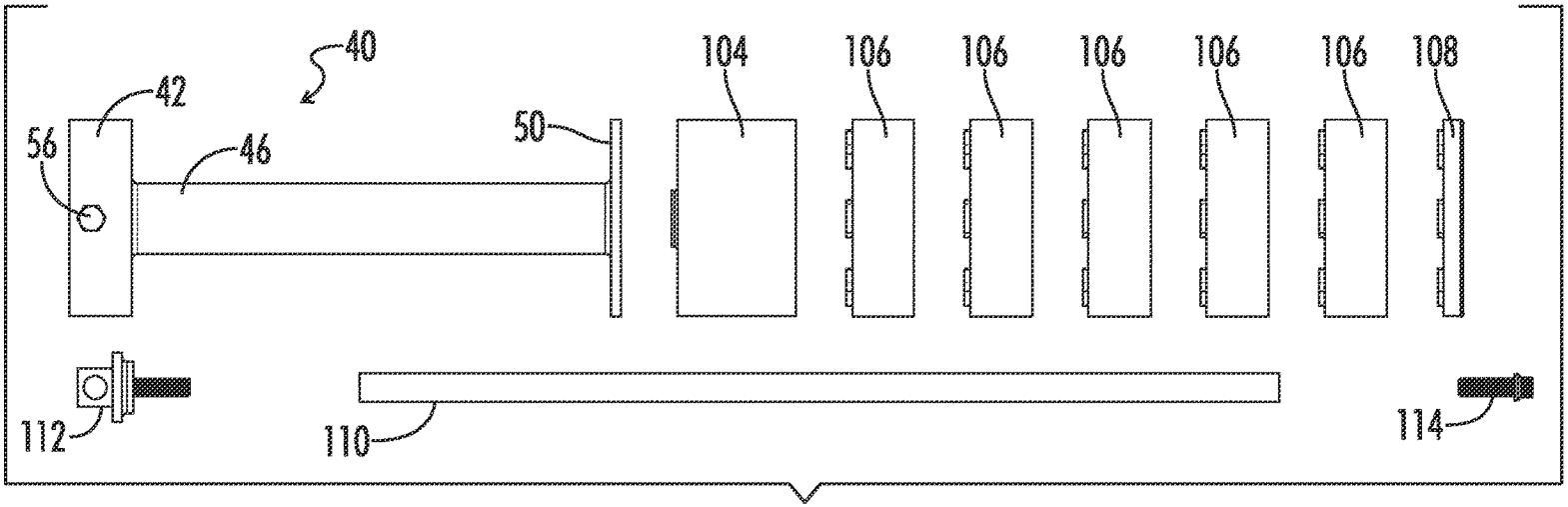
FIG. 6A is an exploded side elevational view of the suppressor of FIG. 5A.
Figure 6B:
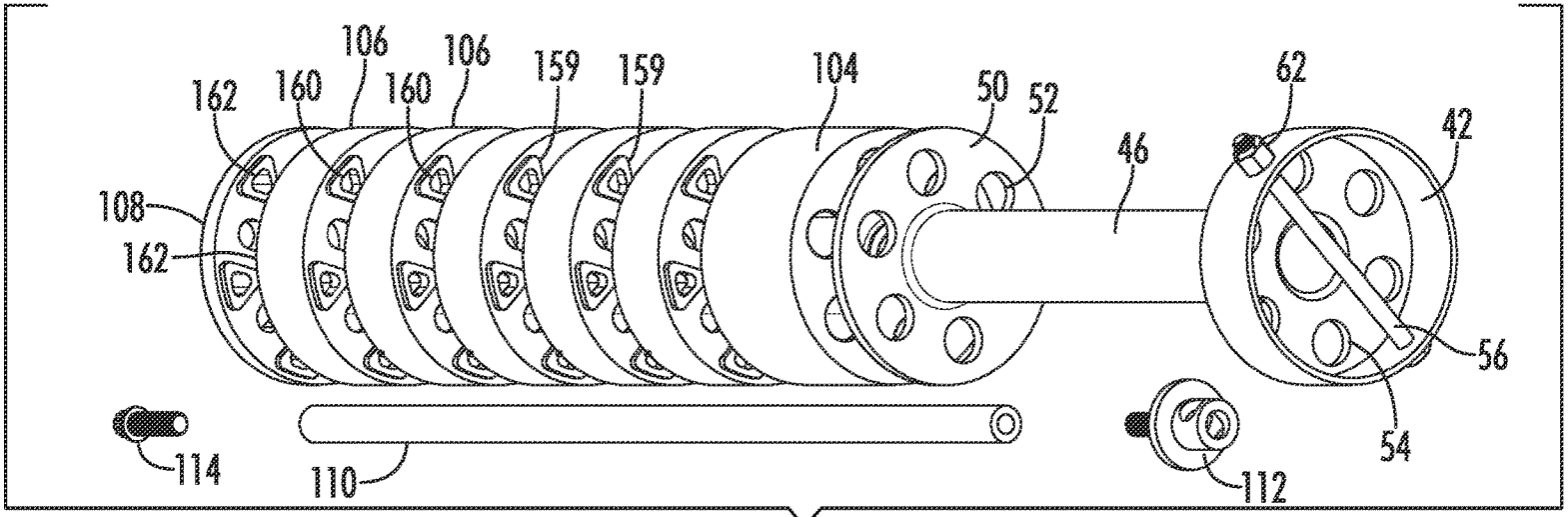
FIG. 6B is an exploded rear isometric view of the suppressor of FIG. 5A.
Figure 7A:
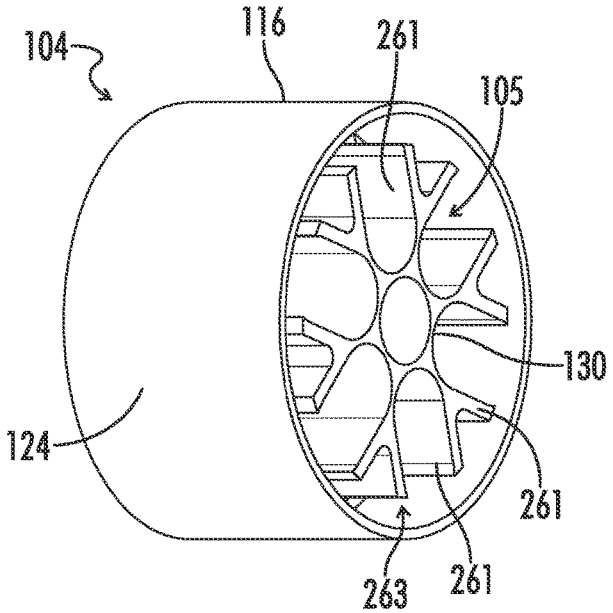
FIG. 7A is a front isometric view of the embodiment of a barrel clamp adapter baffle shown with the suppressor of FIG. 5A.
Figure 7B:
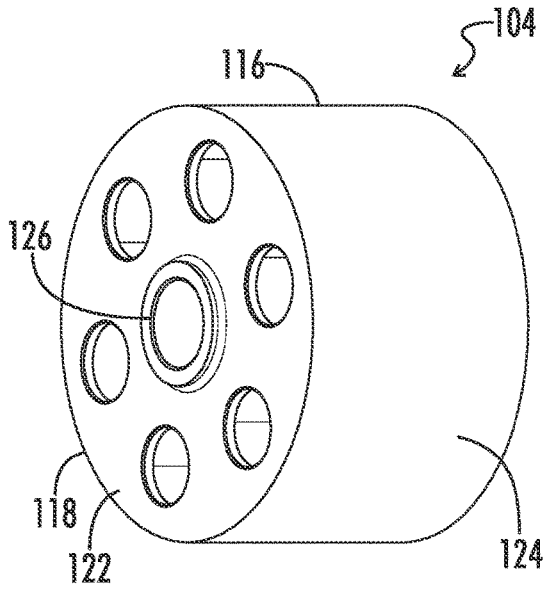
FIG. 7B is a rear isometric view of the adapter baffle of FIG. 7A.
Figure 7C:
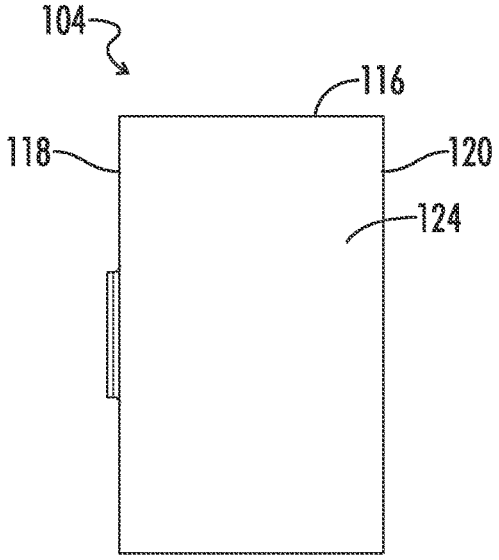
FIG. 7C is a side elevational view of the adapter baffle of FIG. 7A, the other side being a mirror image thereof.
Figure 7D:
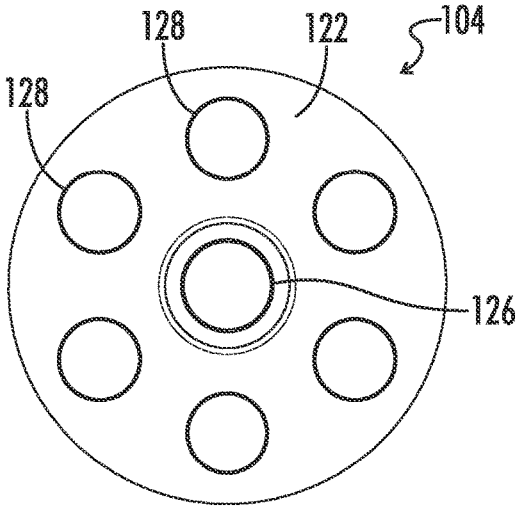
FIG. 7D is a rear elevational view of the adapter baffle of FIG. 7A.

The details of one or more embodiments of the present invention are set forth in this document. Modifications to embodiments described in this document, and other embodiments, will be evident to those of ordinary skill in the art after a study of the information provided herein. The information provided in this document, and particularly the specific details of the described exemplary embodiment(s), is provided primarily for clearness of understanding and no unnecessary limitations are to be understood therefrom. In case of conflict, the specification of this document, including definitions, will control.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

While the terms used herein are believed to be well understood by one of ordinary skill in the art, a number of terms are defined below to facilitate the understanding of the embodiments described herein. Unless defined otherwise, all technical and scientific terms used herein have the same meaning as commonly understood by one of ordinary skill in the art to which the subject matter disclosed herein belongs. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an "upright" position is considered to be the position of apparatus components while in proper operation or in a natural resting position. The upright firing position of a rotary machine gun or other multi barrel weapon system and an attached suppressor is a generally level firing position. As used herein, the term "aft" means in a direction toward a rear end of a weapon, while the term "forward" means in a direction extending away from the rear of the weapon toward the muzzle of a weapon. In some cases, the term "forward" can also mean forward beyond the muzzle of the weapon. "Vertical," "horizontal," "above," "below," "side," "top," "bottom," "upper," "lower," and other orientation terms are described with respect to this upright position during operation, unless otherwise specified, and are used to provide an orientation of embodiments of the invention to allow for proper description of example embodiments. A person of skill in the art will recognize, however, that the apparatus can assume different orientations when in use.

The term "when" is used to specify orientation for relative positions of components, not as a temporal limitation of the claims or apparatus described and claimed herein unless otherwise specified.

The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments.

All measurements should be understood as being modified by the term "about" regardless of whether the word "about" precedes a given measurement.

All references to singular characteristics or limitations of the present disclosure shall include the corresponding plural characteristic(s) or limitation(s) and vice versa, unless otherwise specified or clearly implied to the contrary by the context in which the reference is made.

All combinations of method or process steps as used herein can be performed in any order, unless otherwise specified or clearly implied to the contrary by the context in which the referenced combination is made.

The methods and devices disclosed herein, including components thereof, can comprise, consist of, or consist essentially of the essential elements and limitations of the embodiments described herein, as well as any additional or optional components or limitations described herein or otherwise useful.

Turning now to FIGS. 1A-1D, there are shown multiple views of a new rotary machine gun 2 design according to an embodiment of the present invention. The handles at the rear of the rotary machine gun form the spade grip 3. The central portion of the rotary machine gun is the rotor 4. The rotor 4 defines a central axis 5 about which the barrel cluster 6 rotates during discharge of the machine gun. In the embodiment shown, the rotor 4 has six bolt tracks arranged radially around the central axis 5 of the rotor 4, wherein in each bolt track runs longitudinally along the rotor 4. The rotor 4 is situated within a rotor housing 10 having an elliptical cam path 12. Bolts within the bolt tracks are guided back and forth by the cam path 12 and travel within the bolt tracks to receive and fire ammunition. A drive gear at the forward end 17 of the rotor 4 is driven by the motor gearhead 18. The rotation of the drive gear rotates the rotor 4. At the aft end 19 of the rotor 4 is the clutch gear 20, which mates with the feeder de-linker 22. While the depicted embodiment shows six bolt tracks and corresponding barrels 24, rotary machine guns may have three, four, five, six, or more barrels.

A barrel cluster 6 comprising a set of six barrels 24 is attached to the head of the rotor 4. Each barrel has a muzzle 25 distal to the rotor and a lug 26. The rotor is driven by the main drive motor 28. In the conventional M134 minigun, the motor is located at about the 10 o'clock position above the rotor 4 when standing behind the minigun in the firing position. The main drive motor 28 drives the gearhead 18. The gearhead 18 is fitted to drive the rotor drive gear as described above.

Beneath the drive motor on the left side of the platform when viewed from behind is the feeder de-linker assembly 22. The feeder de-linker 22 receives the linked ammunition (not shown), de-links each cartridge, and transfers the cartridge into the rotor track. In order to meet the precise timing sequence for loading the cartridges into the rotor tracks, the feeder de-linker assembly 22 also has a drive gear that is driven by the clutch gear 20 on the rotor 4. The clutch gear 20 is positioned to mate with the feeder drive gear 32 by a solenoid 34.

The rotary machine gun 2 disclosed herein, as well as other conventional modern rotary machine guns, includes a barrel clamp 40 through which the barrels 24 extend into the rotor 4 and twist 180 degrees to lock in place. The barrel clamp 40 slides over the barrels 24 to keep them from spinning out of the rotor and locked in place. Although different variations of barrel clamps exist, as exemplified in FIGS. 2A through 4D, a barrel clamp 40 typically comprises a shallow cup 42 at the aft end 44, a hollow central shaft 46 extending forward from the cup 42 to the forward or front end 48, and one or more disk-shaped barrel supports 50 fixed to the shaft 46 at different intervals along its length. The shaft 46 defines a central axis 45 of the barrel cluster 6 about which the barrels 24 rotate with the barrel clamp 40 during discharge (i.e., firing) of the machine gun. The central axis 45 defined by the barrel clamp shaft is the same central axis 5 defined by the rotor. The shaft 46 also defines a passage 47 extending from the forward end 48 to the aft end 44 of the barrel clamp. Each disc-shaped barrel support 50 defines a number of barrel apertures 52 which are longitudinally aligned with a corresponding number of barrel apertures 54 in the cup 42. The barrels 24 of the rotary machine gun are received through the aligned barrel apertures 54, 52 in the cup 42 and barrel supports 50, respectively. A cross bolt 56 extends laterally through two opposing holes the cup 58 at the rear of the barrel clamp behind a set of lugs 60 formed on the barrels (i.e., one lug on each barrel) to keep the barrel clamp 40 from sliding forward on the barrels and locked in place. A nut 62 secures the cross bolt 56 in place in the cup 42. Barrel clamps 40 are typically cast out of steel or titanium.

As noted above, variations among barrel clamp designs exist. For example, barrel clamps from different manufacturers can have hollow shafts 46 with different lengths or internal diameters. Additionally, some barrel clamp designs include a flash hider at the forward end, while others do not. FIGS. 2A through 4D depict three different exemplar barrel clamp configurations. The barrel clamp shown in FIGS. 2A-2D has three barrel support discs 50 with six sets of barrel apertures 52 defined therein and no flash hider on the forward end 48. By contrast, the barrel clamp 40 shown in FIGS. 3A-3D has only a single barrel support disc 50 and a solid-sided (i.e., solid-walled) flash hider 64 at the forward end 48. The barrel clamp 40 shown in FIGS. 4A-4D has three barrel support discs 50 with six sets of barrel apertures 52 and a perforated or slotted flash hider 64 at the forward end 48.

Referring again to FIGS. 1A-1C, an embodiment of a flash and sound suppressor (also known as a silencer) 100 is attached to the end of the barrel cluster 6 of the rotary machine gun 2 by integrating into the barrel clamp 40. More specifically, the rotary machine gun 2 has a sound suppressor 100 that is releasably attached to the barrel clamp 40. Connecting the suppressor 100 to the barrel clamp 40 causes the suppressor to rotate with the barrel clamp and the barrel cluster during discharge (i.e., firing) of the machine gun. This in turn increases air induction, which helps cool the suppressor during use and provides a dramatic improvement in performance over conventional stationary firearm suppressors. In some embodiments, the suppressor 100 is adjustable in length. The suppressor 100 can suppress both the flash and the sound produced by firing the rotary machine gun 2, with the amount of suppression increased by lengthening the suppressor 100 as described below.

Referring now to FIGS. 5A through 6B, the suppressor 100 generally includes a series of three differently configured types of baffles stacked on top of one another and secured to the forward or front end 48 of the barrel clamp 40. The stack of baffles 102 includes an adapter baffle 104, one or more substantially identical extension baffles 106, and an endcap baffle 108. A connecting rod 110 extends through the center of each baffle in the baffle stack 102 and the barrel clamp shaft 46. The baffles in the baffle stack 102 surround the connecting rod 110. The connecting rod 110 extends outward from the barrel clamp beyond the muzzles 25 of the barrels 24. One end of the connecting rod 110 is secured to the barrel clamp 40 by a flanged eye bolt 112 and a cross bolt 56. Tightening the flanged eye bolt 112 in the connecting rod 110 applies a clamping force to the baffle stack 102, holding it together and securing it to the barrel clamp 40. A cap nut 114 is tightened onto the other end of the connecting rod 110 to secure and lock the entire stack of baffles 102 in place on the connecting rod.

The baffle most proximal to the rotor 4 is an adapter baffle (also referred to herein as a "blast baffle") 104. The adapter baffle (i.e., blast baffle) 104 engages the barrel clamp 40 and slides over and encloses the muzzles 25 of the barrels 24 of the barrel cluster 6. It defines a large expansion space or blast space 105 in which the initial burst of propellant gases 105 emitted from the muzzles 25 during firing can expand and comingle. The adapter baffle 104 appearing in the baffle stack 102 shown in FIGS. 5A through 6D is depicted more clearly in isolation in FIGS. 7A-7D. The adapter baffle 104 is a generally cylindrical body 116 having an aft end 118 and a forward end 120. The adapter baffle includes a plate 122 and a solid, generally cylindrical sidewall 124 extending normal from a circumferential edge of the plate. Solid in this context means that the sidewall has no holes or apertures therethrough not filled by a bolt or other fixture. The plate 122 is at the aft end 118 of the adapter baffle, and the sidewall 124 extends forwardly from the plate. However, in other embodiments, the plate 122 can be positioned between the aft 118 and forward 120 ends. A central hole 126 is defined through a center of the plate 122. The connecting rod 110 is received in the central hole 126. A plurality of barrel apertures 128 are defined through the plate 122. The barrel apertures 128 are radially and equidistantly spaced about the central hole 126. A hollow central stem 130 extends forwardly from the plate 122, parallel to the sidewall 124. The stem 130 extends forwardly from the circumferential edge of the central hole 126. The connecting rod 110 is receivable in and extends forward and aft through the central stem 130 when the suppressor 100 is assembled on the barrel clamp 40.

Figure 8A:
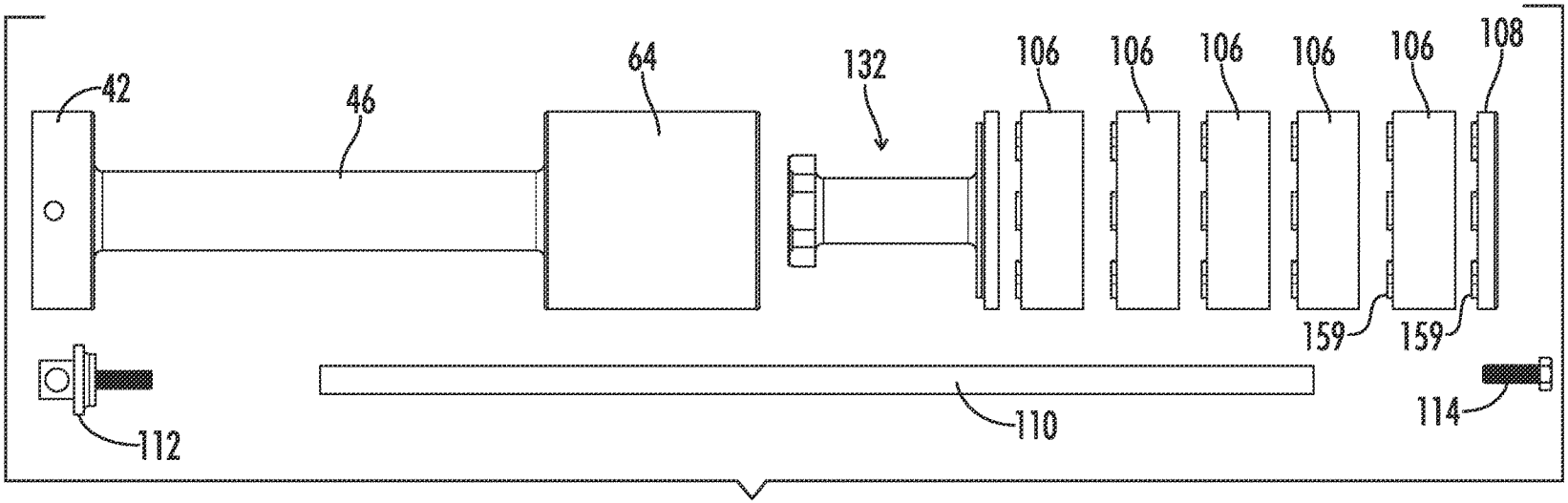
FIG. 8A is an exploded side elevational view of another embodiment of a suppressor for a rotary machine gun constructed in accordance with the present invention.
Figure 8B:
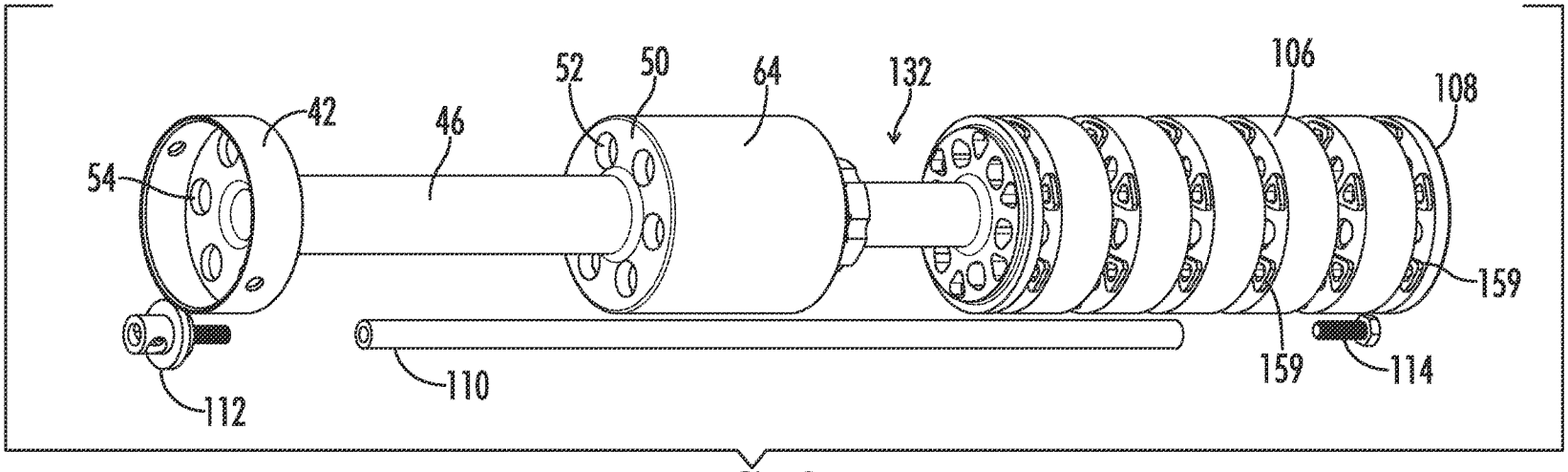
FIG. 8B is an exploded rear isometric view of the suppressor of FIG. 8A.
Figure 9B:
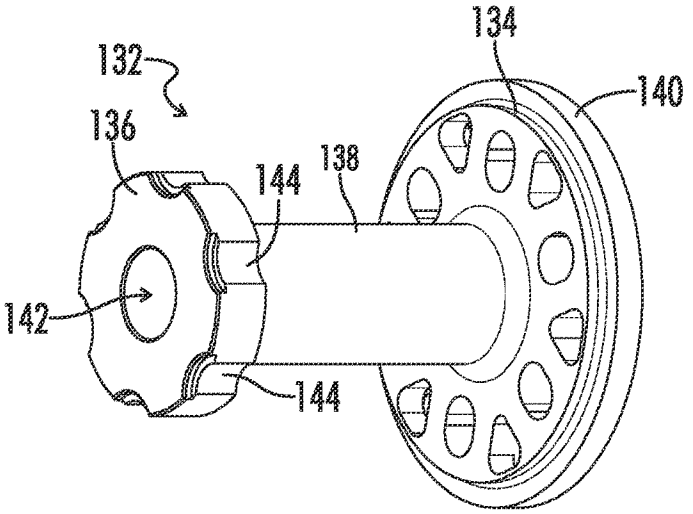
FIG. 9B is a rear isometric view of the flash hider adapter of FIG. 9A.
Figure 9D:
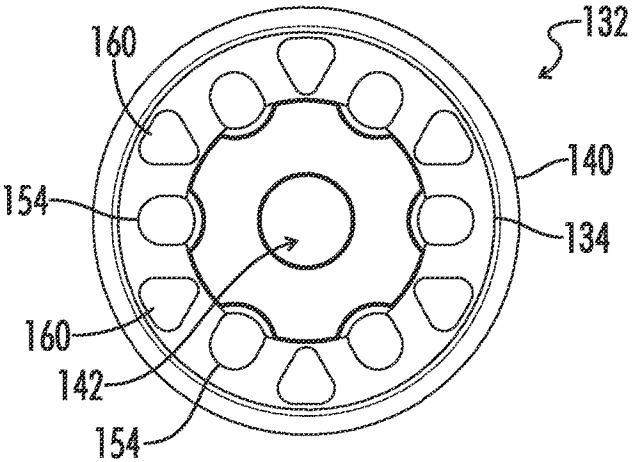
FIG. 9D is a rear elevational view of the flash hider adapter of FIG. 9A.
Figure 9A:
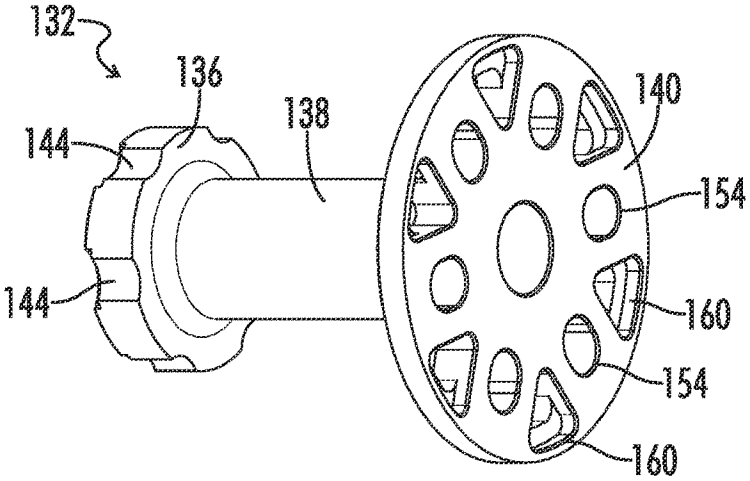
FIG. 9A is a front isometric view of an embodiment of a barrel clamp flash hider adapter shown with the suppressor of FIG. 8A.
Figure 9C:
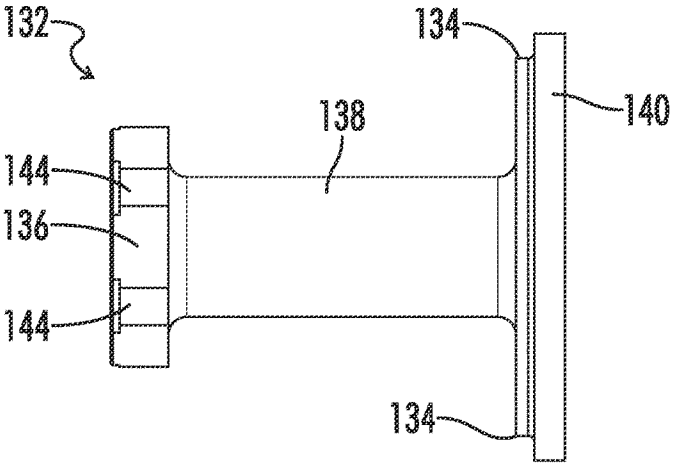
FIG. 9C is a side elevational view of the flash hider adapter of FIG. 9A, the other side being a mirror image thereof.

In other embodiments, such as the embodiment depicted in FIGS. 8A and 8B of a suppressor 100 for a rotary machine gun having a barrel clamp 40 with an integral flash hider 64, the adapter baffle 104 of FIGS. 7A-7D is replaced with a flash hider adapter 132 as exemplified in FIGS. 9A through 9D. Unlike adapter baffle 104, the flash hider adapter 132 uses the sidewalls of the native barrel clamp flash hider 64 to form the expansion or blast space 105 for propellant gases. The flash hider adapter 132 includes a base plate 136, a hollow central shaft 138 extending forwardly from the base plate 136, and an adapter plate 140 at the forward end of the shaft 138. The shaft 138 defines a passage 142 through which the connecting rod 110 extends. The base plate 136 has a diameter slightly larger than the diameter of the space defined between opposing barrels 24 of the barrel cluster 6. Instead of barrel apertures 128, the base plate 136 has formed in a circumferential edge thereof a plurality of channels or recesses 144 which correspond in number to the quantity of barrels 24 forming the barrel cluster 6. This way, when the base plate 122 is received against the forwardmost barrel support disc 50 of the barrel clamp 40, each barrel of the barrel cluster will be received in a corresponding recess 144. This prevents the flash hider adapter 132 from slipping against the barrels 24 and forces the flash hider adapter 132 to rotate with the barrel cluster 6. A protruding lip 134 formed on the rear surface of the adapter plate 140 is sized to fit closely within the open end of the flash hider. This stabilizes the forward end of the flash hider adapter 132 against rotation forces applied to it during discharge and thereby prevents the adapter 132 from being dislodged from the barrel clamp 140. Projectile apertures 154 and overpressure apertures 160 are defined through the adapter plate 140 to allow projectiles and high pressure gases to move forward through the barrel cluster 102. As such, an adapter of one type or the other (i.e., an adapter baffle 104 or flash hider adapter 132) allows the suppressor 100 to be fitted to any configuration of barrel clamp 40 for the rotary machine gun 2.

Figure 10A:
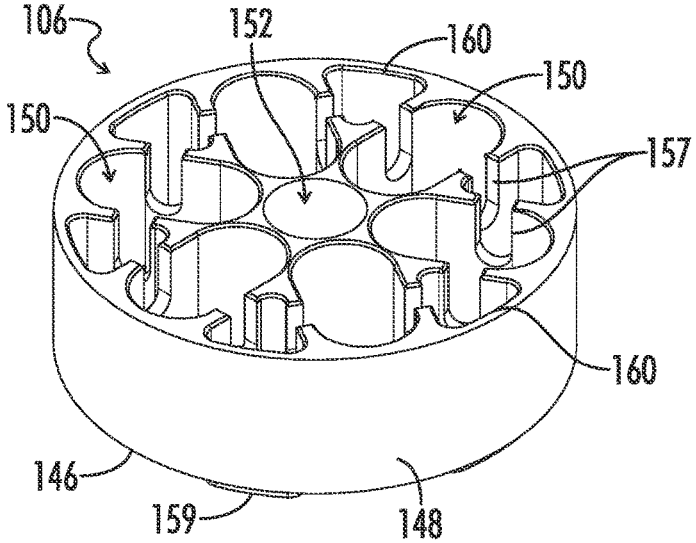
FIG. 10A is a front isometric view of an embodiment of an extension baffle shown with the suppressors of FIGS. 5A through 8B.

Referring now to FIGS. 10A though 10C, an individual extension baffle 106 is depicted. The extension baffle 106 includes a plate 146 and a solid cylindrical exterior wall 148 defining an interior space 150 having an interior diameter larger than the diameter of the barrel cluster. The plate 146 covers one end of the cylindrical exterior and has an outside face facing away from the interior space 150 and an inside face facing toward the interior space. A central hole 152 sized to fit around the connecting rod 110 is defined through the center of the plate 146. A number of projectile apertures 154 are defined through the plate 146. The projectile apertures 154 are radially spaced about the central hole 152. The projectile apertures 154 align with the barrels 24 to permit fired projectiles to travel unimpeded through the extension baffle 106. When assembled into a suppressor, the projectile apertures 154 of each extension baffle 106 are aligned with the projectile apertures 154 of each adjacent extension baffle 106, the projectile apertures in the adapter baffle 104 or flash hider adapter 136 (whichever is used in the baffle stack), and corresponding aligned projectile apertures 156 in the endcap baffle 108 to form a plurality of projectile paths (i.e., bore spaces) 158 through which each projectile fired from each successive barrel passes when traveling through the baffle stack 102 toward a target.

Figure 10B:
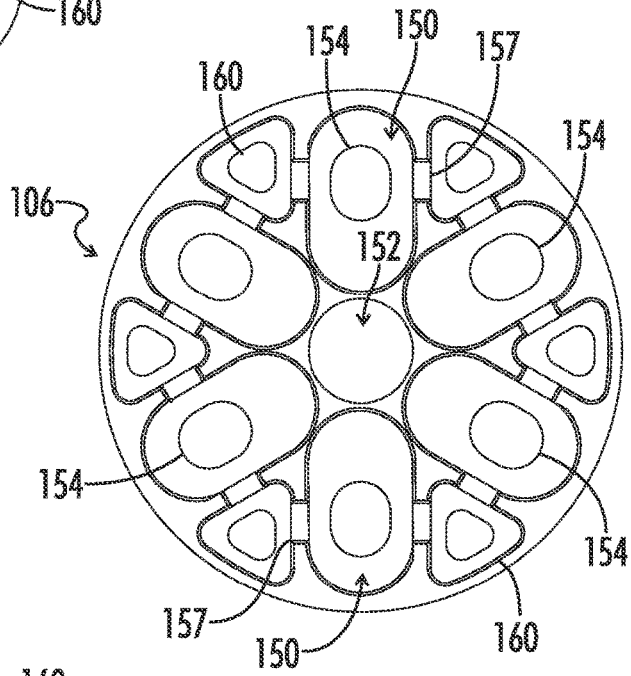
FIG. 10B is a front elevational view of the extension baffle of FIG. 10A.
Figure 10C:
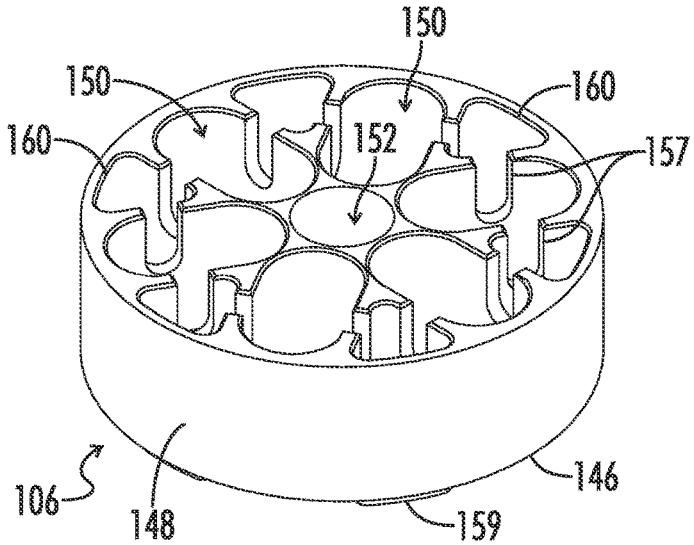
FIG. 10C is another front isometric view of the extension baffle of FIG. 10A.

In some embodiments, each projectile aperture 154 of an extension baffle 106 may have a surrounding structure such as a conical wall 159 extending rearwardly to enhance the light and sound suppression capabilities of the assembled suppressor and assist with indexing each baffle to an adjacent baffle in the stack 102. In the embodiment shown in FIGS. 10A-10C, the outside face of the plate 146 is substantially flat. In other embodiments the outside face of the plate 146 may be curved or graded. The inside face can have a relief structure 157 to provide structural support to the extension baffle 106 and to facilitate dispersion of propellant gasses emitted from each barrel muzzle 25 during firing. The remainder of the space 150 within the extension baffle 106 forms a continuous chamber or cavity connecting two or more of the multiple bore spaces (i.e., projectile paths) 158, permitting gas within the extension baffle 106 to circulate among and around the entirety of the baffle space 150 common to the plurality of projectile apertures 154 and the bore spaces 158.

The extension baffle plate 146 can also have additional overpressure apertures 160 define therein. The overpressure apertures 160 facilitate the flow of propellant gases from one extension baffle to the next extension baffle in the stack. Thus, each baffle space 150 within each baffle is interconnected with every other baffle space 150 throughout the baffle stack 102 to form a single continuous cavity or chamber 155 running throughout the suppressor 100 from the adapter baffle 104 or flash hider adaptor 132 to the endcap baffle 108. The endcap baffle 108 can also have overpressure apertures 162 permitting excess gas to exit the front end of the suppressor 100. The endcap baffle 108 is shown as being substantially flat on both sides. However, in other embodiments, the endcap baffle 108 need not be flat on both sides. The endcap baffle 108 also includes projectile apertures which align with the projectile apertures 154 in the extension baffles 106 when the baffles are arranged in a stack 102 as described herein.

The design of the extension baffles 106 means that each extension baffle contains a plurality of projectile apertures 154 which, when stacked with additional extension baffles 106, creates a plurality of parallel projectile pathways 158 in alignment with the plurality of barrels 24 through the length of the baffle stack 102. In the embodiment shown, the rotary machine gun 2 has six barrels 24. A continuous chambered baffle stack 102 or assembly sharing all six bore spaces 158 (i.e., in which all projectile apertures are in fluid communication with one another) creates a larger volume (compared to individual suppressors affixed to each barrel) that allows higher volumes of gas, created by the combustion of the propellant, to expand, slow down, and develop turbulence before exiting the endcap baffle 108 into the ambient air or atmosphere outside of the suppressor. The overpressure apertures 160, 162 ensure that the large amounts of expanding propellant gasses generated during firing pass safely from the adaptor baffle 104 or flash hider adapter 132, through the series of adjacent extension baffles 106, and out the endcap baffle 108 without causing pressure to build up to an unsafe level.

In some embodiments, each baffle in the stack 102 (e.g., the adaptor baffle 104 or flash hider adapter 132, the extension baffles 106, and the endcap baffle 108) can be keyed to one another or have a guide or other aligning element 159 so that each baffle stacks into an adjacent baffle or adapter with all projectile apertures in proper longitudinal alignment with each other and the muzzles 25 of the barrels.

Advantages of the designs and embodiments described herein include that rotary machine guns using a sound suppressor disclosed herein have very little or significantly reduced flash signature, which allows night vision devices to be used with no or minimal consequences at night, thereby permitting the operator to effectively utilize night vision equipment. Rotary machine guns equipped with a suppressor disclosed herein can also distort or confuse the enemy by masking its sound signature so as to not give away an operator's precise position. Additionally, by slowing rapidly expanding propellant gases, suppressors disclosed herein also reduce perceived recoil, thereby enhancing accuracy and increasing rounds on target. Furthermore, the added weight of suppressor components reduces barrel vibration or "wandering" from a target and keeps the weapon on target during the initial startup of the gun and associated torque (or muzzle rise) during firing.

Figure 11A:
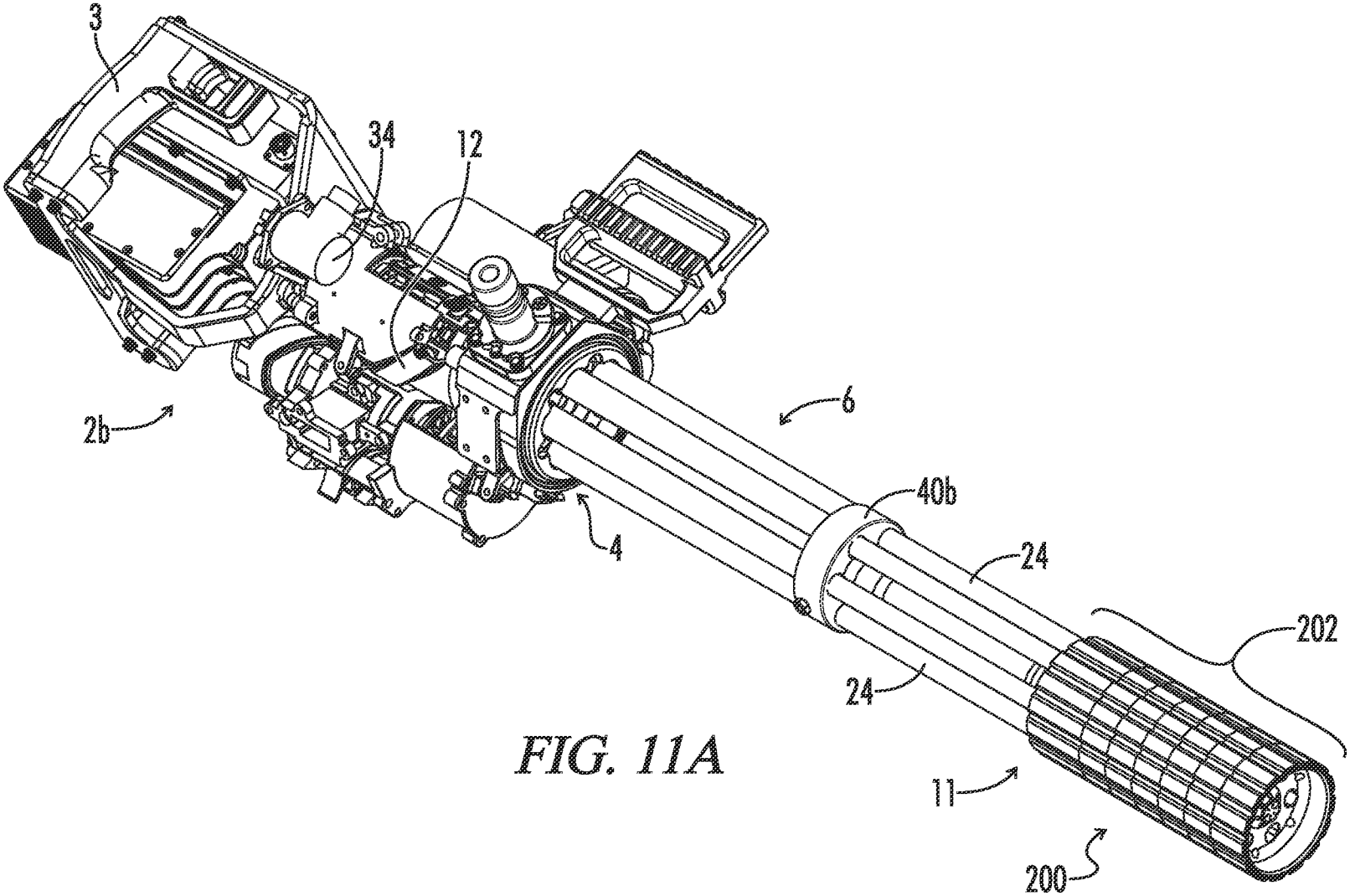
FIG. 11A is a bottom right side isometric view of another M134 rotary machine gun with a suppressor constructed in accordance with another embodiment of the present invention mounted thereon.

Turning now to FIG. 11A, there is depicted another embodiment of an M134 rotary machine gun 2*b* with a suppressor 200 constructed in accordance with another embodiment of the present invention mounted thereon. Rotary machine gun 2*b* has a barrel cluster 6 with six rotating barrels 24 and is alike to machine gun 2 in all respects except as specifically described herein.

Figure 11B:
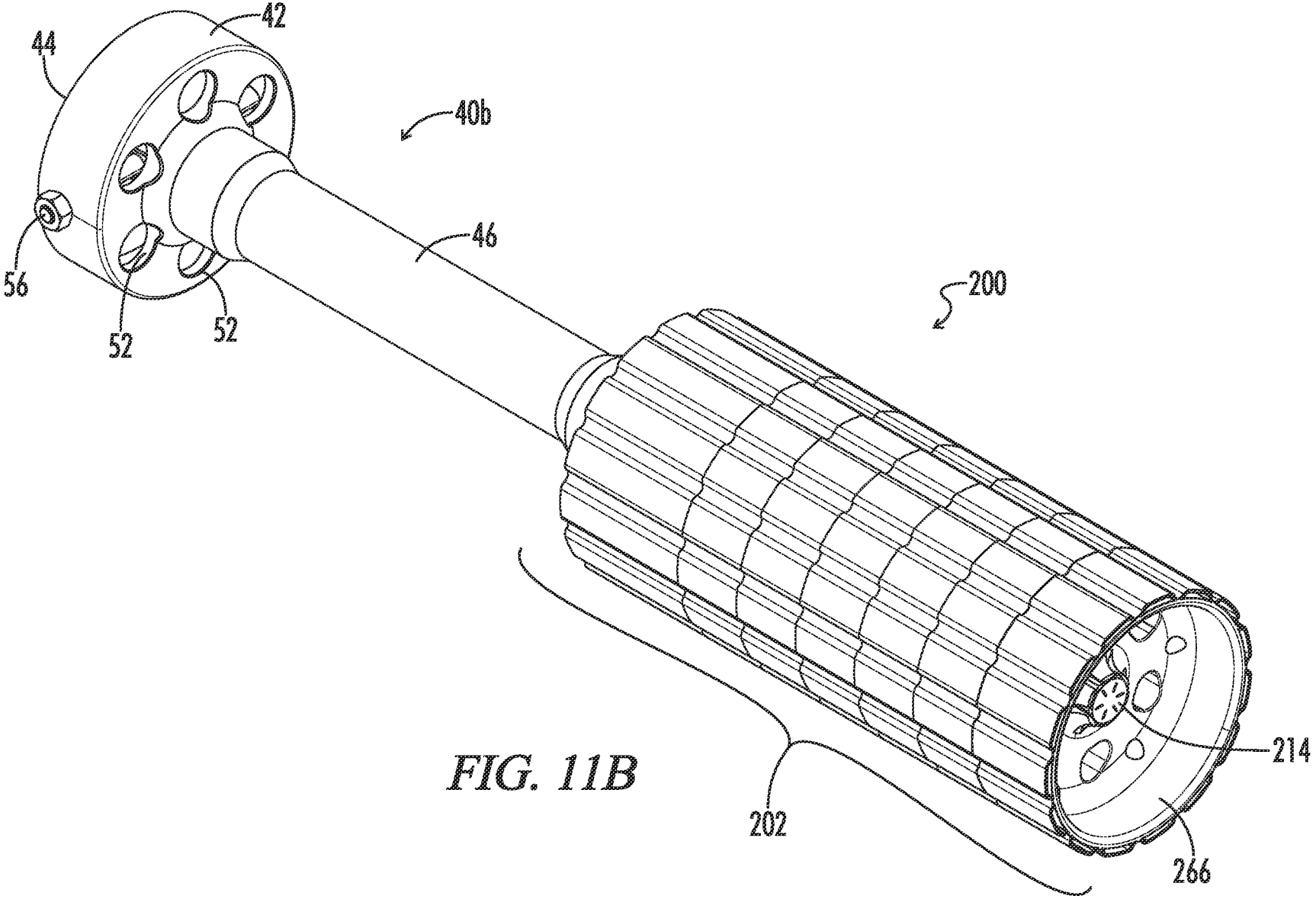
FIG. 11B is an elevated front isometric view of the suppressor of FIG. 11A with the rotary machine gun omitted.
Figure 12:
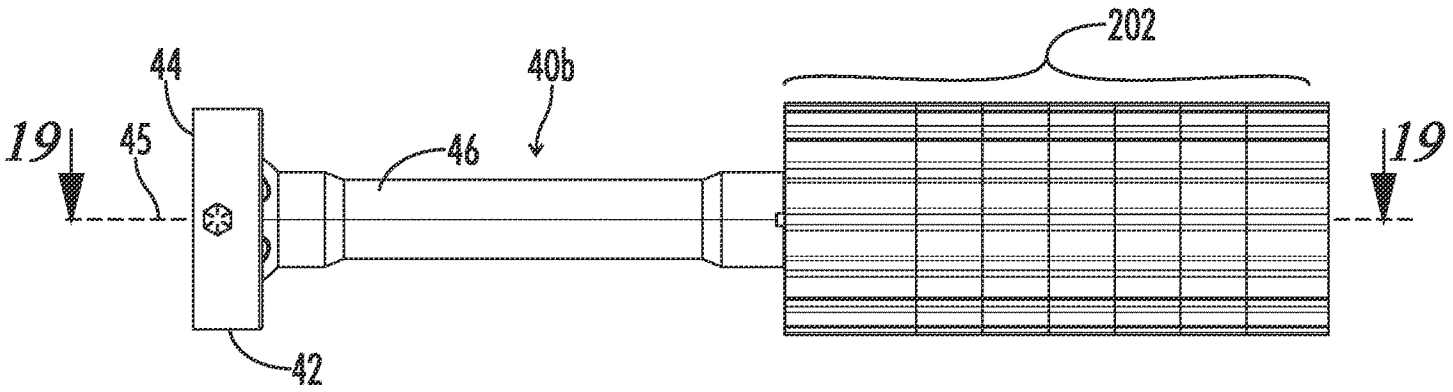
FIG. 12 is a right-side elevational view of the suppressor of FIG. 11B.
Figure 14:
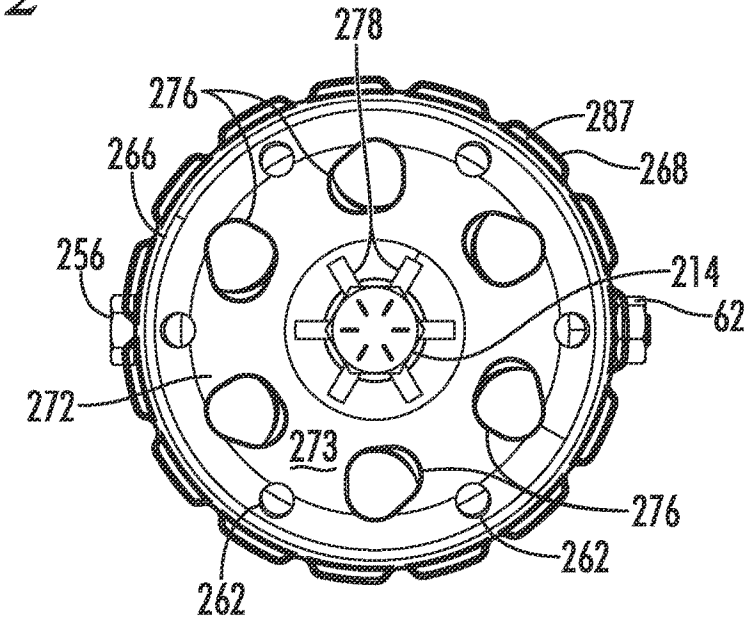
FIG. 14 is a front elevational view of the suppressor of FIG. 11B.
Figure 13:
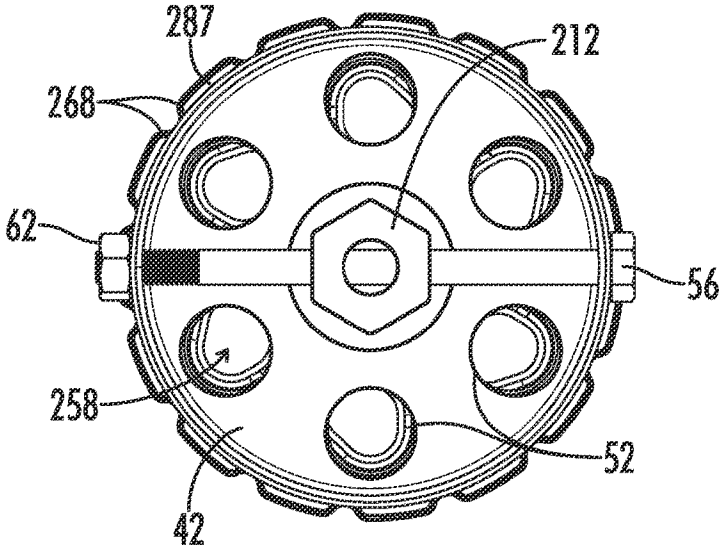
FIG. 13 is a rear elevational view of the suppressor of FIG. 11B.
Figure 15:
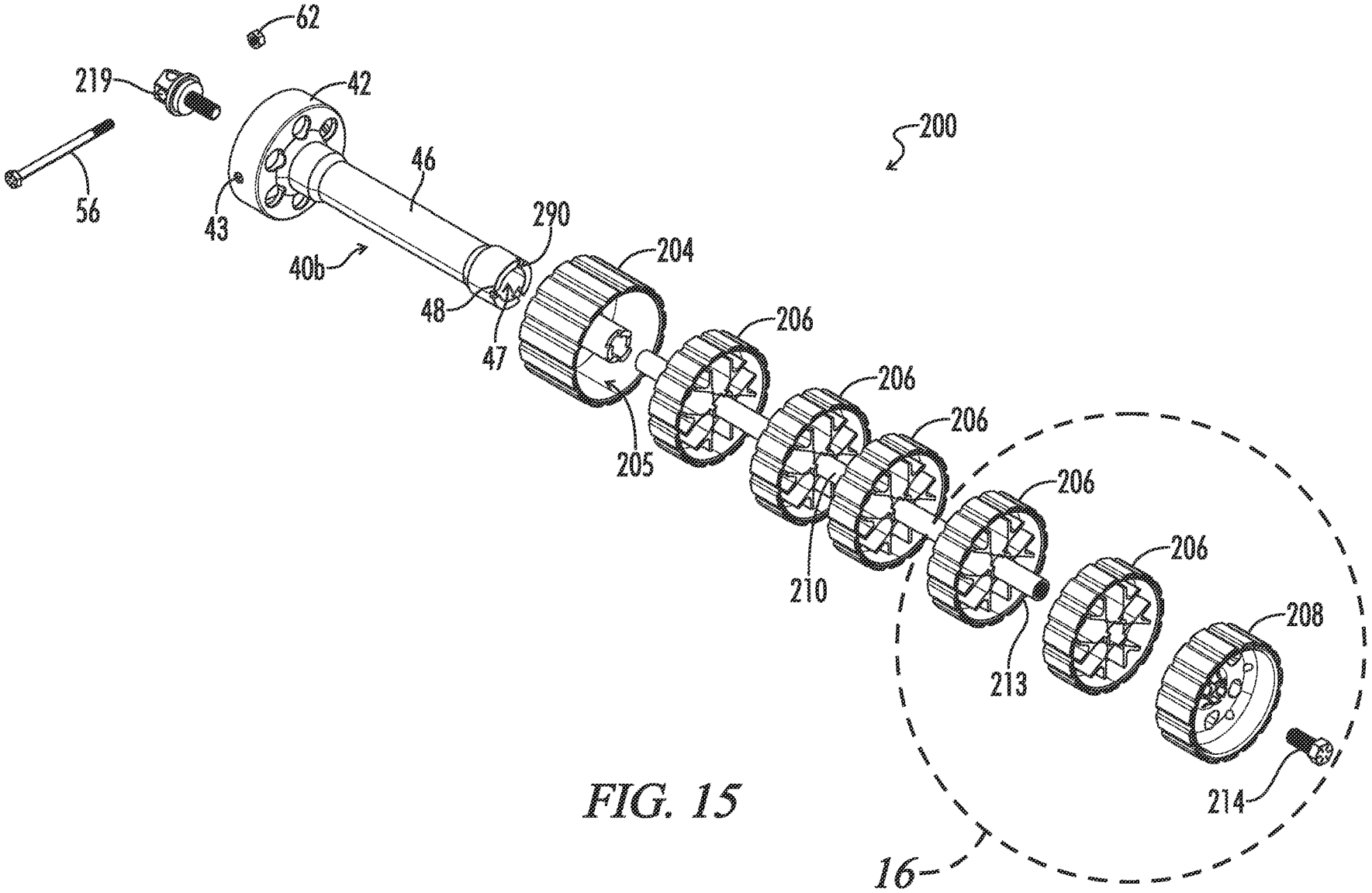
FIG. 15 is an elevated, partially exploded, front isometric view of the suppressor of FIG. 11B.
Figure 16:
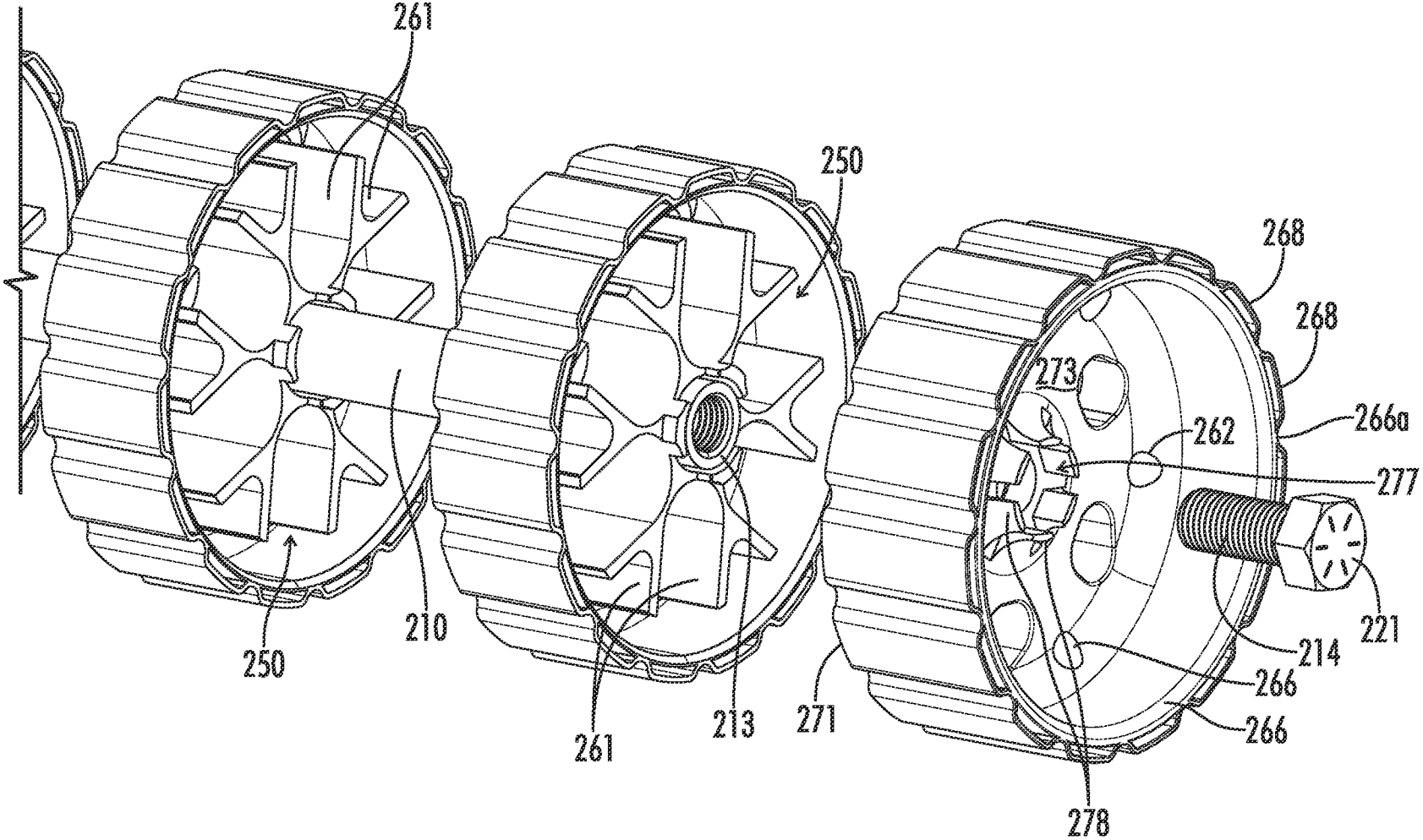
FIG. 16 is an expanded detail view of the objects at location 16 of FIG. 15.
Figure 17:
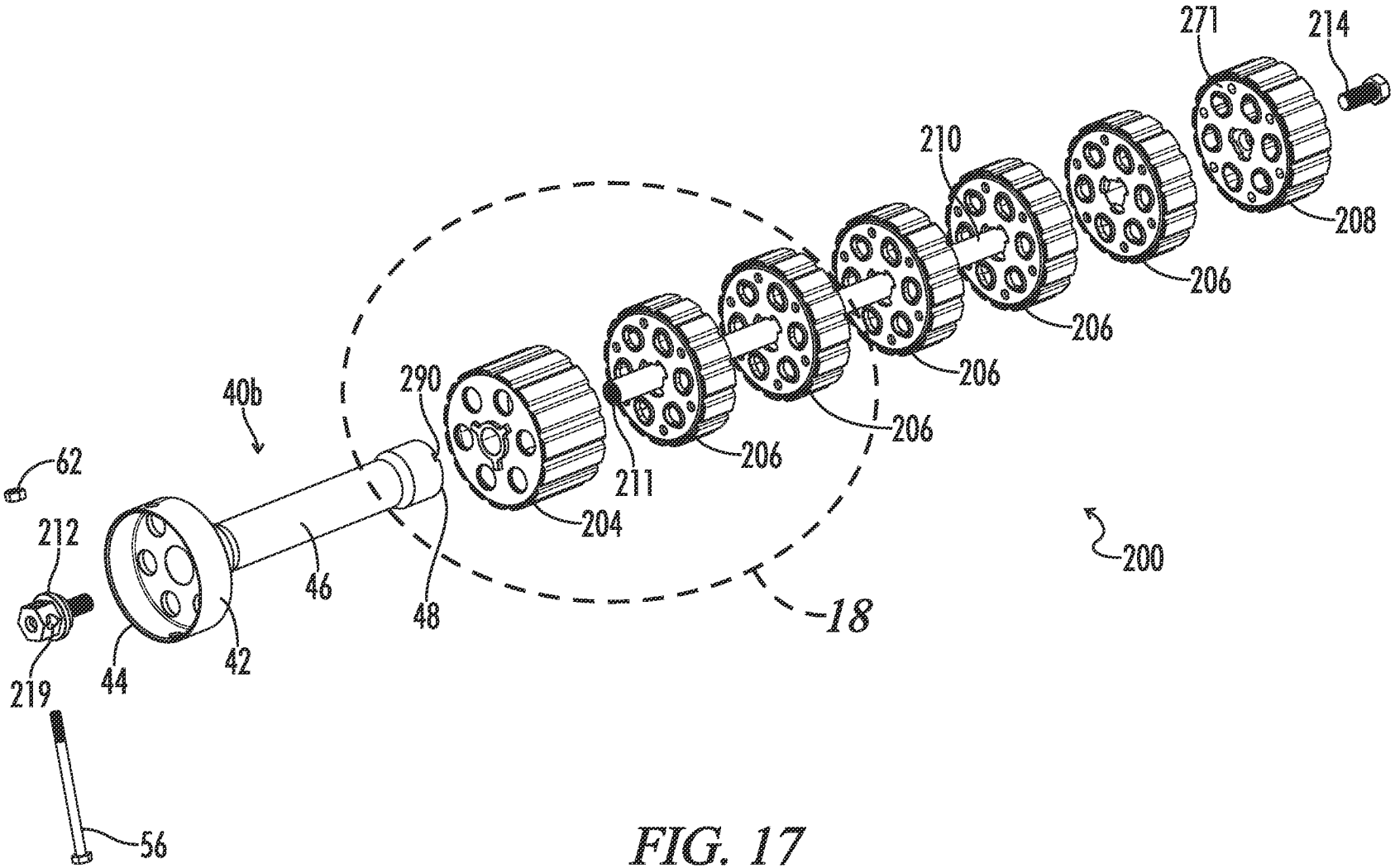
FIG. 17 is an elevated, partially exploded, rear isometric view of the suppressor of FIG. 11B.
Figure 18:
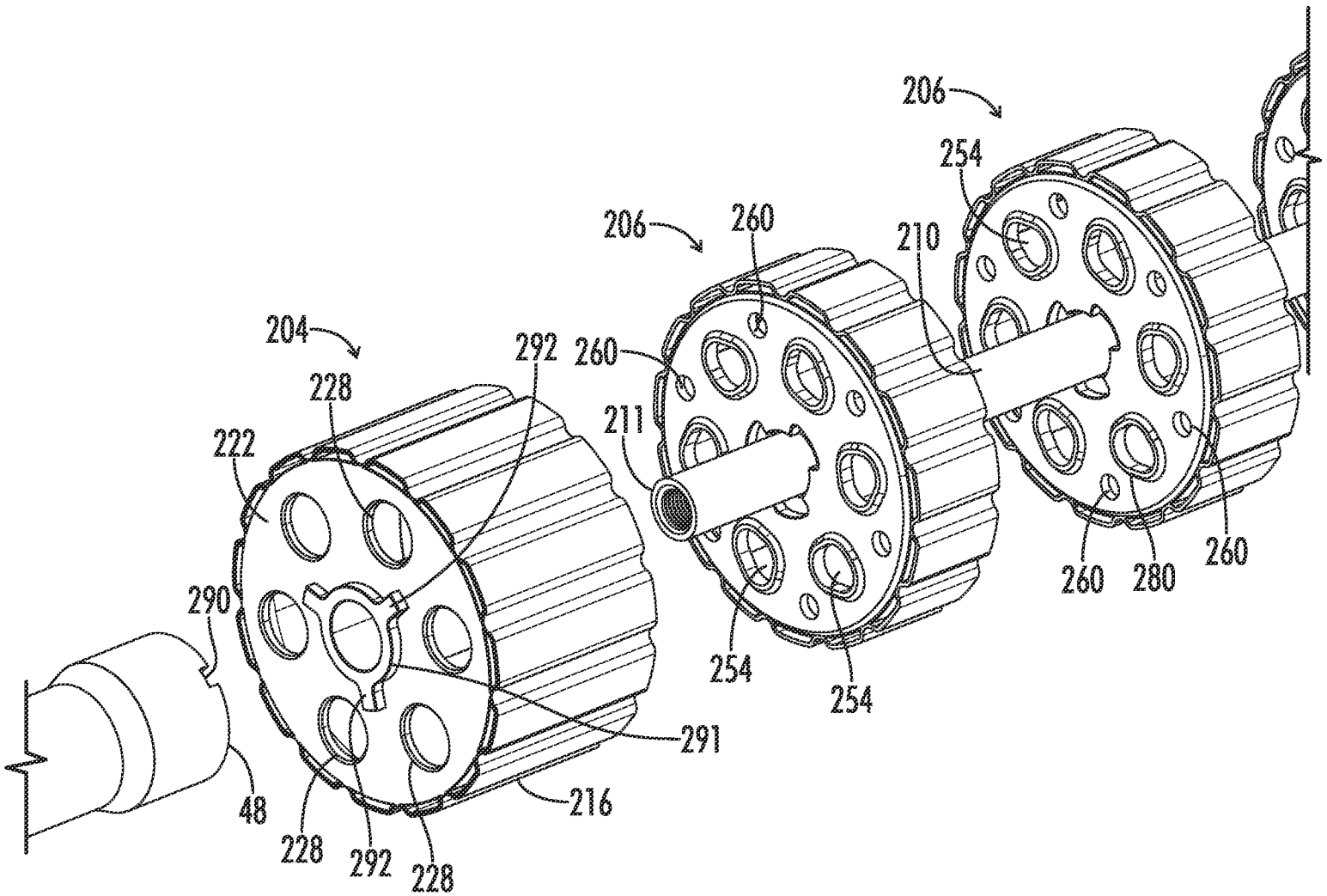
FIG. 18 is an expanded detail view of the objects at location 18 of FIG. 17.
Figure 19A:
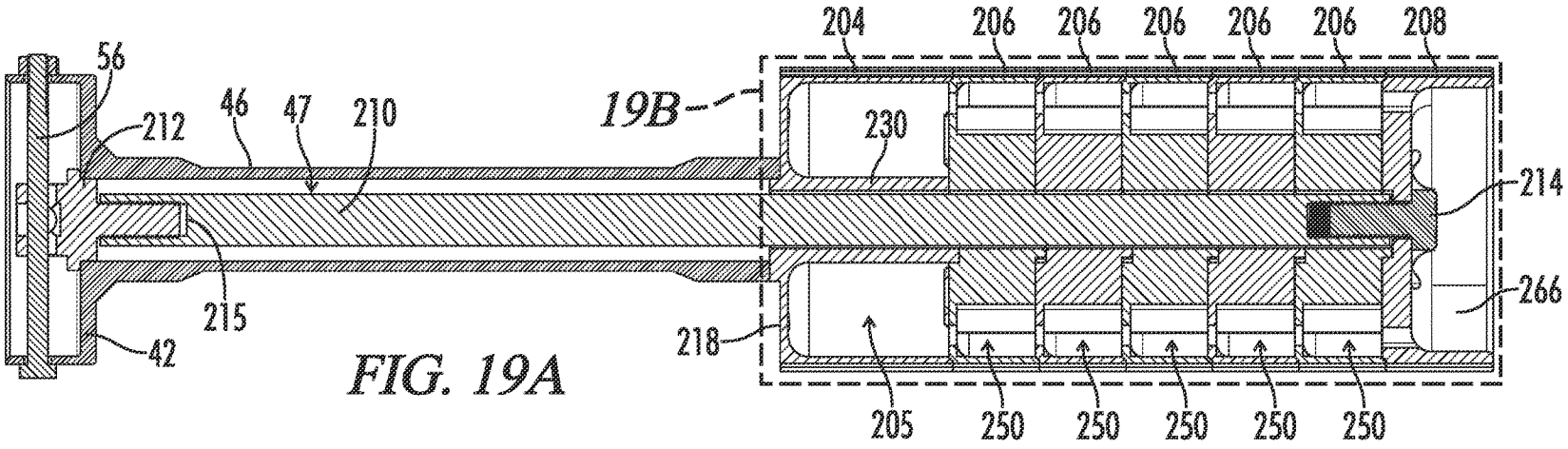
FIG. 19A is a sectional view taken along line 19-19 of FIG. 12.
Figure 19B:
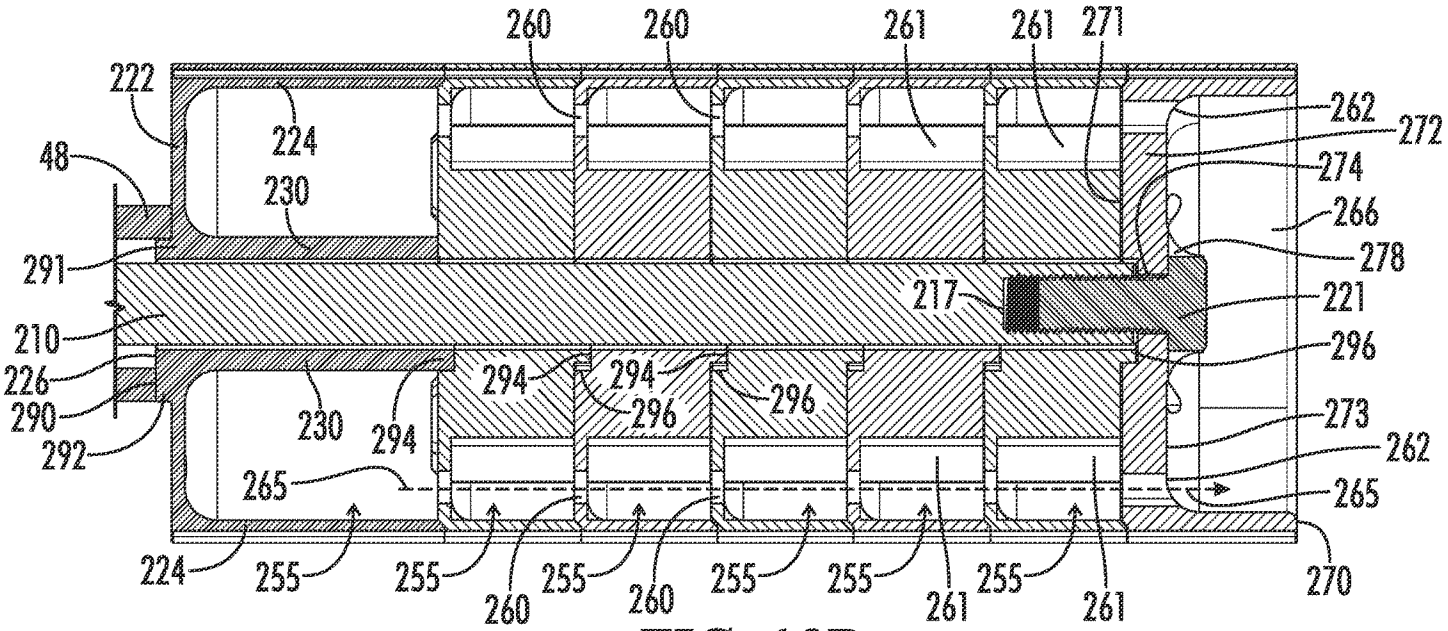
FIG. 19B is an expanded detail view of the objects at location 19B of FIG. 19A.
Figure 19C:
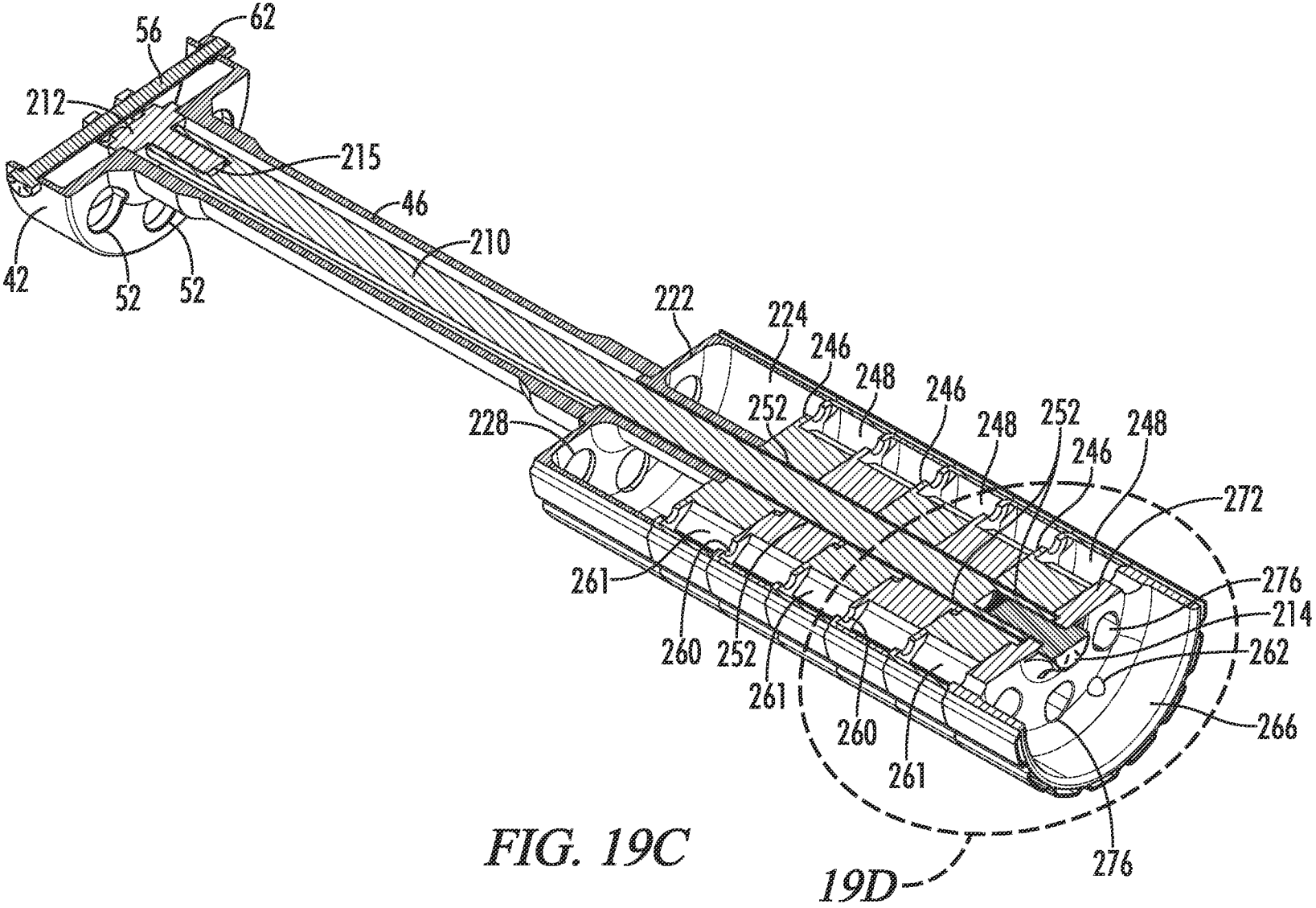
FIG. 19C is an elevated front isometric view of the suppressor of FIG. 19A.
Figure 19D:
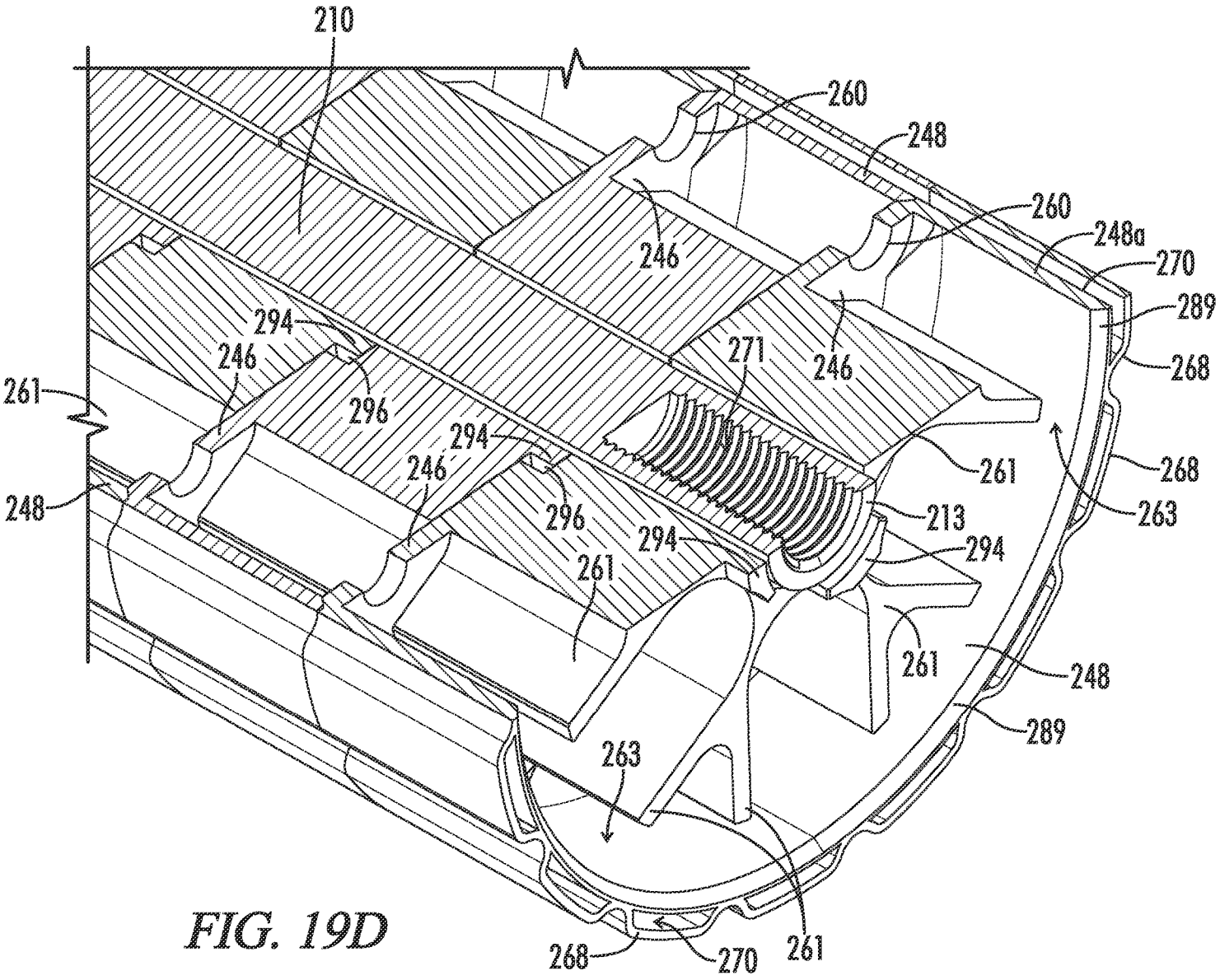
FIG. 19D is an expanded detail view of the objects of FIG. 19C at location 19D with the endcap baffle and threaded fastener omitted.

As better shown in FIGS. 11B though 24, suppressor 200 generally includes a series of three types of differently configured baffles arranged in stack 202 and secured to the forward end 48 of a novel barrel clamp 40*b*. The barrel clamp 40*b* includes an aft end 44 with shallow cup portion 42 and a hollow central shaft 46 defining an interior passage 47 extending forwardly from the cup portion 42. The shaft 46 also defines a central axis 45 about which the barrels 24 of the machine gun 2*b* rotate with the barrel clamp 40*b* during discharge of the machine gun 2*b* when the barrels 24 are supported by the barrel clamp 40*b*. The central axis 45 is the same as a central axis 5 defined by either machine gun 2 or machine gun 2*b*. A plurality of barrel apertures 52 are defined through the cup portion 42. The barrel apertures 52 are radially spaced from the shaft 46. Securing the baffle stack 202 to the barrel clamp 40*b* causes the baffles, and thus the entire suppressor, to rotate with the barrel clamp 40*b* and the plurality of barrels 6 about the central axis 45 during discharge of the machine gun when the plurality of barrels is supported by the barrel clamp 40*b*. The barrel clamp 40*b* of FIGS. 11A though 21D lacks disk-shaped barrel supports 50 and has a uniquely configured front end 48 as described in more detailed below.

The stack of baffles 202 includes an adapter baffle 204 (sometimes interchangeably referred to herein as a "blast baffle"), one or more extension baffles 206 in series, and an endcap baffle 208. A connecting rod 210 extends through the center of each baffle in the baffle stack 202 and the passage 47 in the barrel clamp shaft 46 along the central axis 45. The connecting rod 210 has an aft end 211 and a forward end 213. Each of the aft and forward ends 211, 213 defines a threaded socket 215, 217. A first threaded fastener in the form of a flanged hex head eye bolt 212 is receivable in threaded socket 215 to secure the aft end 211 of the connecting rod 210 to the aft end of the barrel clamp 44 at the cup 42. A second threaded fastener 214 in the form of a hex head bolt 214 is receivable in threaded socket 217 at the forward end 213 of the connecting rod 210 to secure the baffle stack 202 to the forward end of barrel clamp 40*b*. Tightening either fastener 212, 214 applies a clamping force to the baffle stack 202 through the connecting rod 210, thereby compressively securing the baffle stack 202 to the barrel clamp 40*b*. Conversely, loosening the second threaded fastener 214 in the forward end of the connecting rod 210 releases the baffle stack 202 from the forward end of barrel clamp 40*b*.

A cross bolt 56 extending through an eye hole 219 in the first threaded fastener 212 and corresponding aligned holes 43 in opposing sides of the barrel clamp cup 42 can secure the barrel clamp 40*b* and the assembled suppressor 200 to the barrel cluster 6 in the traditional manner with the cross bolt 56 extending through the barrel cluster 6 behind the barrel lugs 60 (not shown). This configuration also prevents the cross bolt 56 from inadvertently rotating around the central axis 45 relative to the connecting rod 210 and thereby loosening the compressive force holding the baffle stack 202 together on the barrel clamp 40*b*. A nut 62 engages the threaded end of the cross bolt 56 and secures the cross bolt 56 in position within the barrel clamp cup 42 and the eye 219 of the first threaded fastener 212.

It is to be understood, however, that although the connecting rod 210 is depicted as having two female threaded ends 215, 217, in some embodiments, the connecting rod can be formed with one female threaded end and one male threaded end, or with two male threaded ends. In such embodiments, the first and second threaded fasteners 212, 214 can vary in form as needed to suit the threading configuration of the connecting rod 210. For example, when the connecting rod 210 is provided with male threads at the forward end, the corresponding second threaded fastener 214 should be a fastener with female threads, such as an endcap nut. If the aft end 211 of the connecting rod 210 is provided with male threads, the corresponding first threaded fastener 212 should also be a fastener with female threads and a suitable hole or eye 219 through which the cross bolt 56 is receivable to secure the connecting rod 210 to the cup 42 of the barrel clamp 40*b*. Ordinarily skilled artisans will recognize that additional configurations for securing the connecting rod 210 are possible. All are within the scope of the present invention.

The baffle adjacent to and engaging the forward end 48 of the barrel clamp 40*b* is another embodiment of an adapter baffle (also sometimes referred to herein as a "blast baffle") 204. As best shown in FIGS. 22A through 22F, the adapter or blast baffle 204 is a generally cylindrical body 216 having an aft end 218 and a forward end 220. The adapter baffle 204 includes a plate 222 and a solid, generally cylindrical sidewall 224 extending normal from a circumferential edge of the plate. Solid in this context means that the sidewall 224 has no holes or apertures therethrough not filled by a bolt or other fixture. The plate 222 is at the aft end 218 of the adapter baffle, and the sidewall 224 extends forwardly from the plate. However, in other embodiments, the plate 222 can be positioned between the aft and forward ends. A central hole 226 is defined through a center of the plate 222. The connecting rod 210 is received in the central hole 226. A plurality of barrel apertures 228 are defined through the plate 222. The barrel apertures 228 are radially and equidistantly spaced about the central hole 226. A hollow central stem 230 extends forwardly from the plate 222, parallel to the sidewall 224. The stem 230 extends forwardly from the circumferential edge of the central hole 226. The connecting rod 210 is receivable in and extends forward and aft through the central stem 230 when the suppressor 200 is assembled on the barrel clamp 40*b*.

Figure 20:
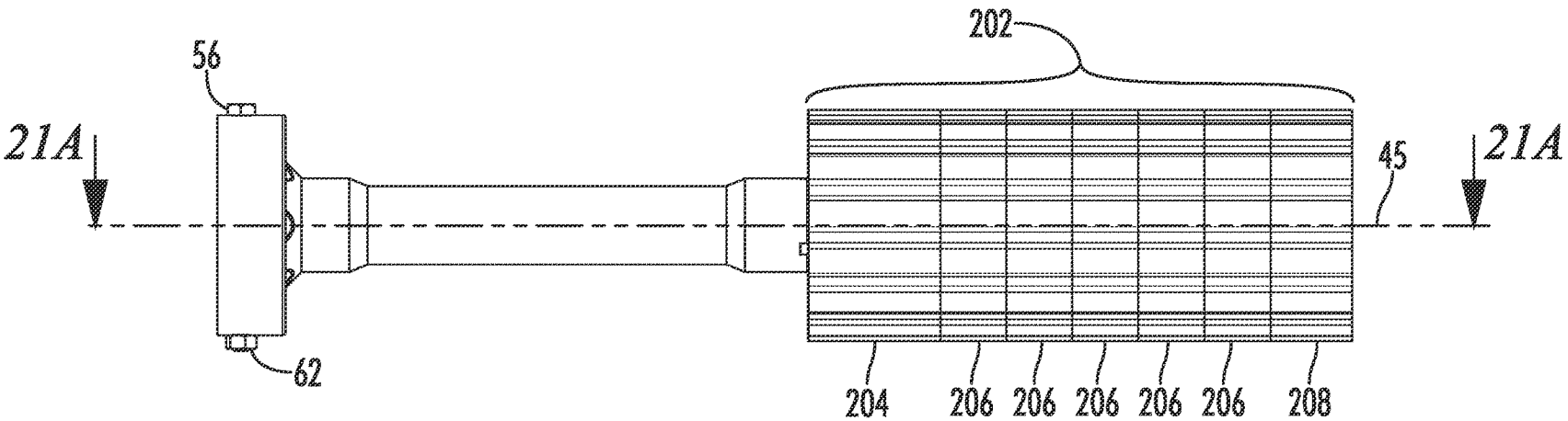
FIG. 20 is a bottom plan view of the suppressor of FIG. 11B.
Figure 21A:
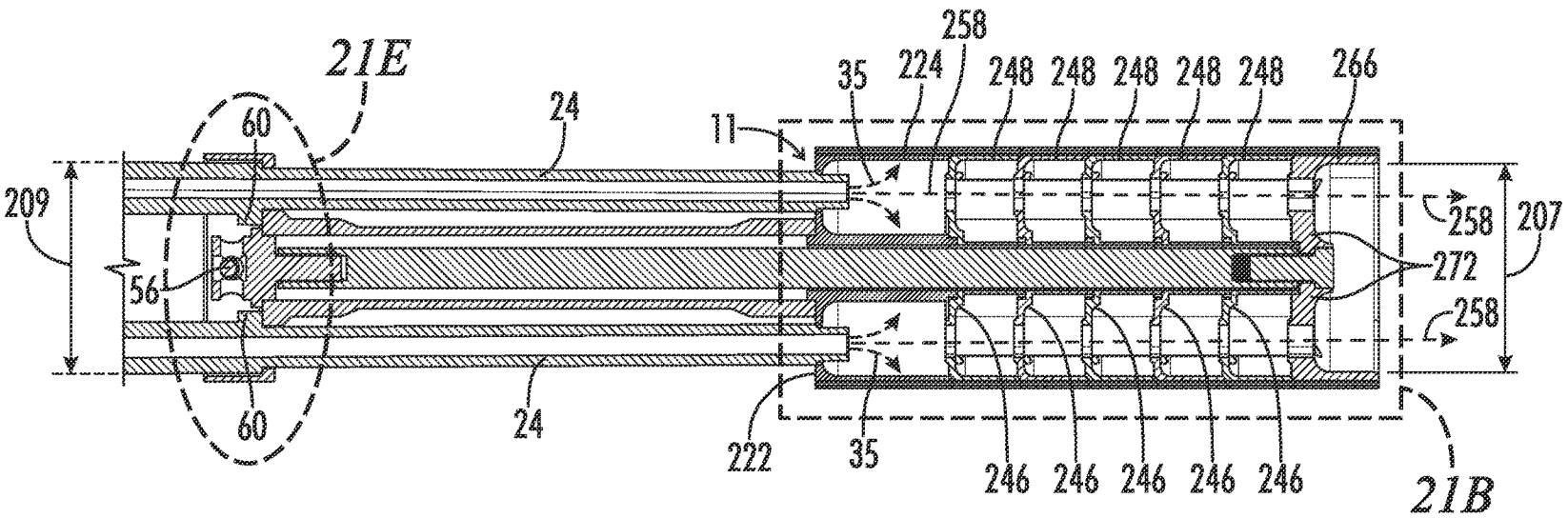
FIG. 21A is a sectional view taken along line 21-21 of FIG. 20 shown with two of the six barrels of the rotary machine gun of FIG. 11A properly seated therein.
Figure 21B:
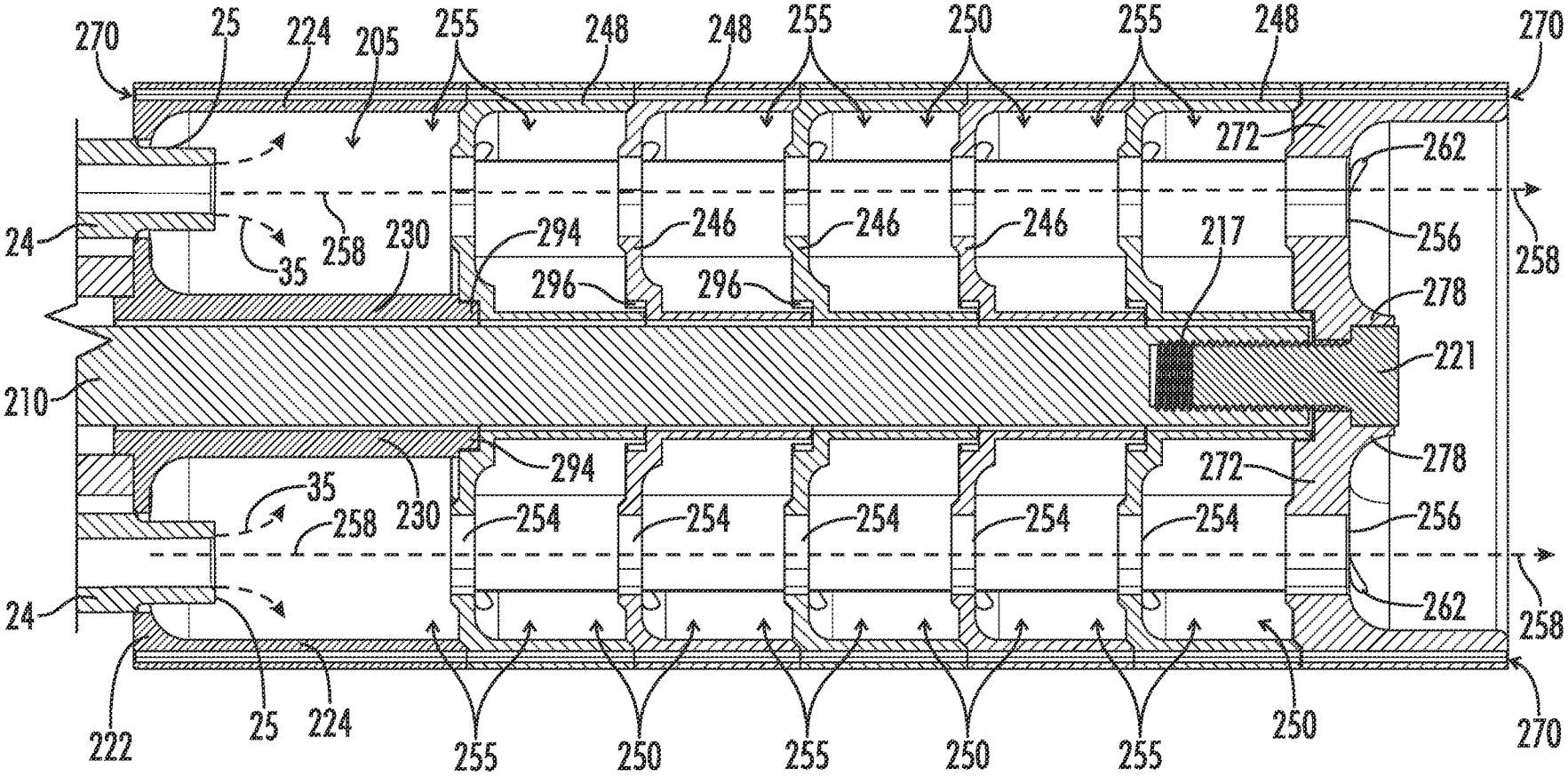
FIG. 21B is an expanded detail view of the objects of FIG. 21A at location 21B.
Figure 21C:
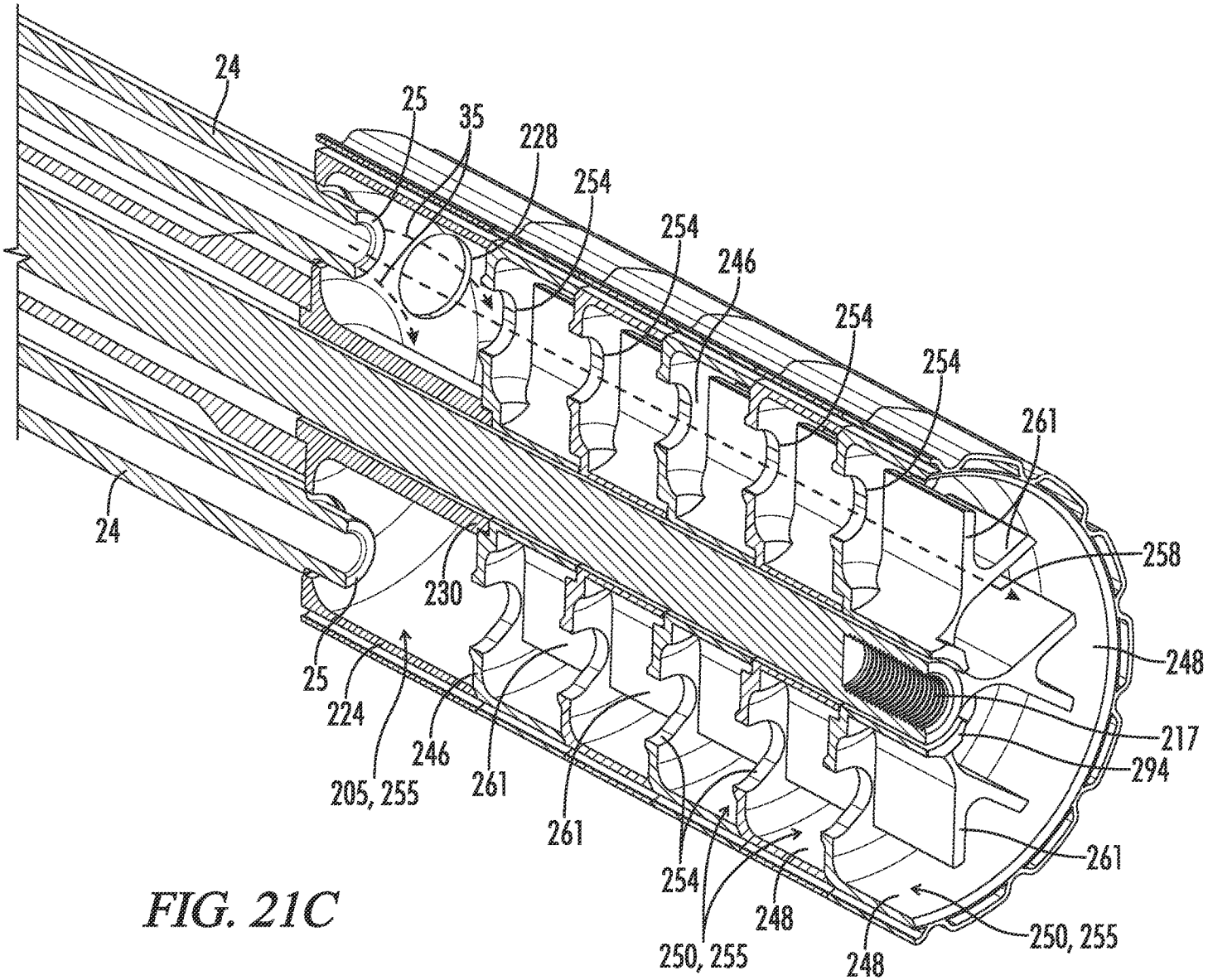
FIG. 21C is an elevated front isometric view of the objects at location 21B of FIG. 21A.
Figure 21D:
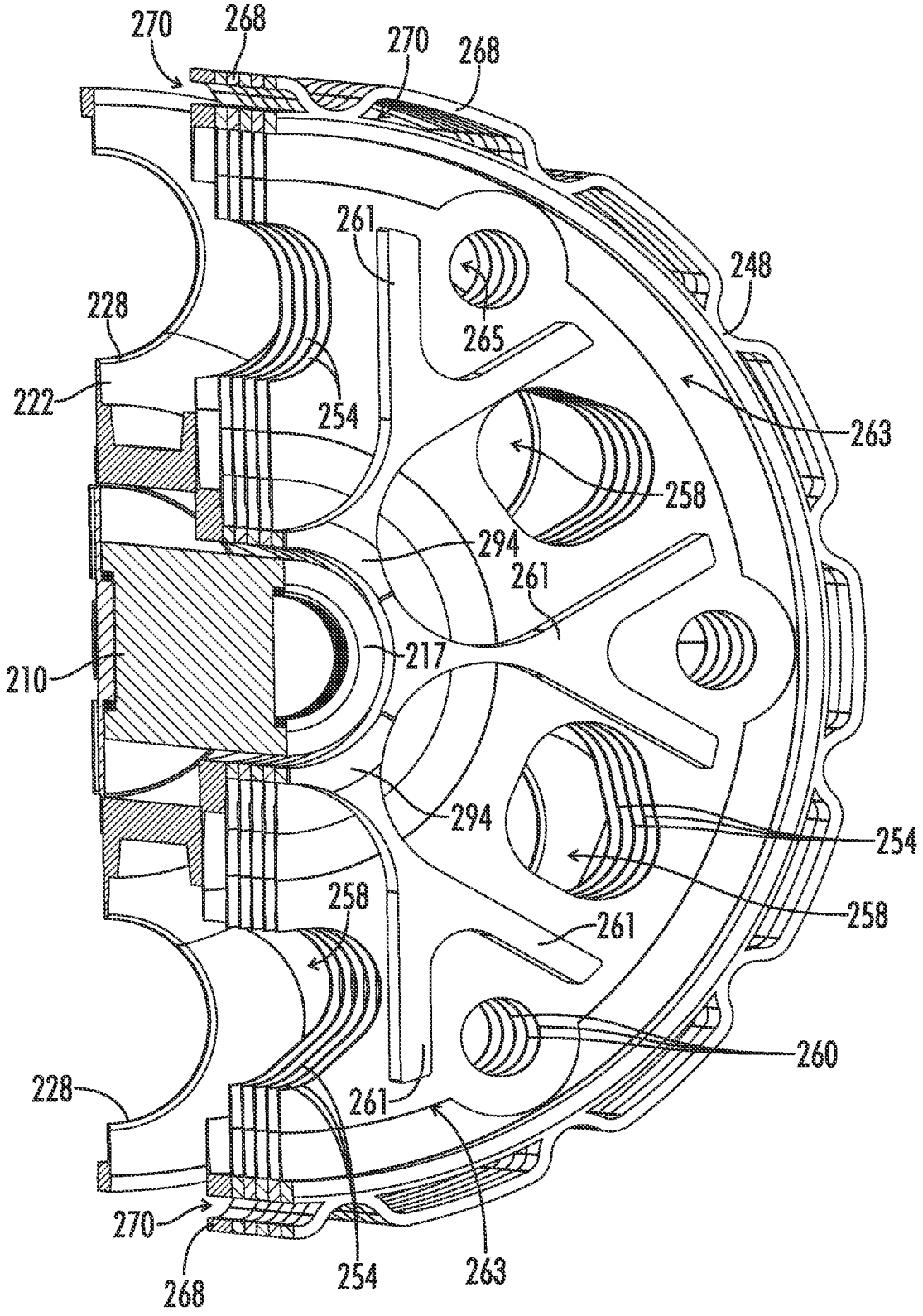
FIG. 21D is a front isometric view of the objects of FIG. 21C with the barrels omitted for clarity.
Figure 21E:
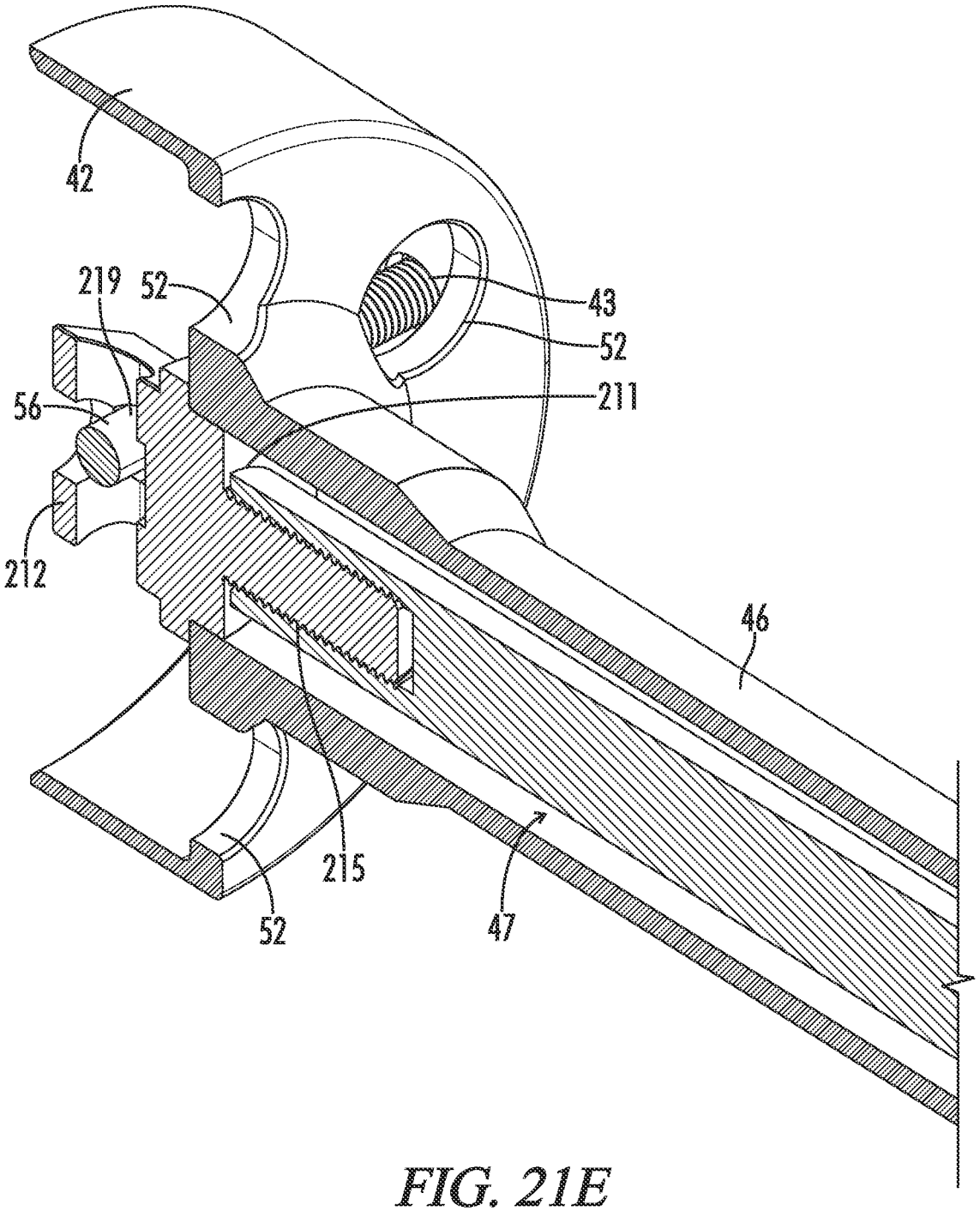
FIG. 21E is an elevated front isometric view of the objects at location 21E of FIG. 21A.

As shown in FIGS. 20 and 21A, the end portion of each barrel 24 of the barrel cluster 6 is receivable in the barrel apertures 228 of the adapter baffle 204 so that muzzle 25 of each barrel 24 of the barrel cluster 6 is received in the adapter baffle 204. The sidewall 224 extends forwardly beyond the muzzle 25 of each barrel 24 when the barrels are received in the barrel apertures 228. In this way, the adapter baffle 204 surrounds the muzzles 25 of all the barrels 24 of the barrel cluster 6 at the same time. The plate 222 and sidewall 224 define a single interior expansion space 205 (i.e., blast space) around the central stem 230. The end portions of the barrels 24 are receivable into the adapter baffle 204 through the barrel apertures 228 so that the muzzle 25 of each barrel rests inside the expansion space 205. The expansion space 205 has a diameter 207 larger than the diameter 209 of the forward end 11 of the barrel cluster 6 so that all of the muzzles 25 of the barrels 24 can fit inside the interior expansion space 205 of the adapter baffle 204 together. Each muzzle 25 is in fluid communication with each other muzzle 25 through the expansion space 205 when the muzzles 25 are received in the adapter baffle 204.

The muzzles 25 are received in adapter baffle 204 when the muzzle 25 of each barrel 24 is longitudinally disposed within the expansion space 205 between the plate 222 and the forward end 220 of the sidewall 224. The muzzles should, but need not necessarily, sit closer to the aft end 218 of the baffle (e.g., just forward of the plate 22) than the forward end 220 so as to allow propellant gases 35 to expand as much as possible before continuing forward through subsequent baffles of the suppressor. The expansion space 205 is shaped and sized to facilitate immediate expansion and comingling of propellant gases 35 (indicated by arrows in FIG. 21A) emitted from each of the barrel muzzles 25 during discharge (i.e., firing) of the machine gun. As such, when the muzzles 25 are received in the adapter baffle 204, propellant gases 35 emitted from the muzzles 25 during discharge expand and comingle in the interior expansion space 205 before traveling forward through the baffle stack 202 and eventually out the endcap baffle 208 into the atmosphere. In some embodiments, the adapter baffle 204 is longer (i.e., has a greater distance between its aft and forward ends) than the extension baffles 206 so as to provide a large space for initial expansion, comingling, and slowing of propellant gases 35.

Referring again to FIGS. 11 through 21C, the suppressor 10 includes a plurality of extension baffles 106 stacked in series against the forward end 220 of the adaptor baffle 204.

Figure 23A:
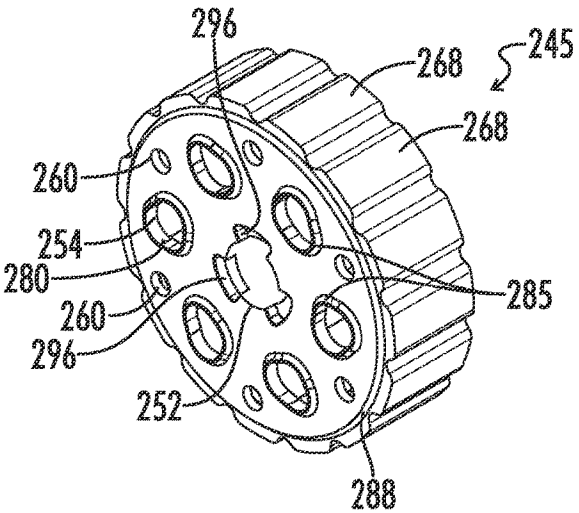
FIG. 23A is an elevated rear isometric view of an extension baffle of the suppressor of FIG. 11B.
Figure 23B:
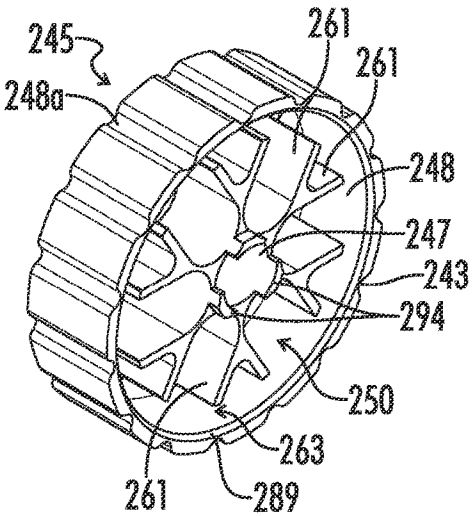
FIG. 23B is an elevated front isometric view of the extension baffle of FIG. 23A.
Figure 23D:
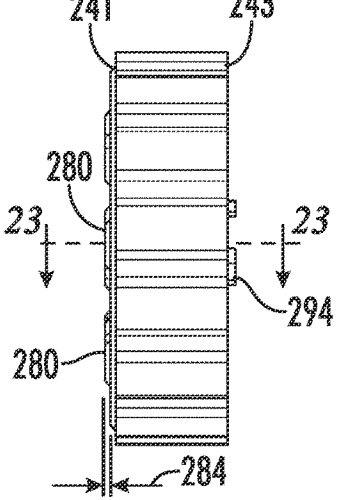
FIG. 23D is a right-side elevational view of the extension baffle of FIG. 23A, the other side being a mirror image thereof.

Each extension baffle 206 is configured to longitudinally align with and engage either the adapter baffle 204 or another extension baffle 206. As best shown in FIGS. 23A through 2311, each extension baffle 206 is substantially identical. This simplifies both manufacturing and assembly of the suppressor 200, and reduces the number of parts needs for repairs should a baffle become damaged in the field. Although the exemplar embodiment shown in the figures is depicted with five extension baffles 206, it is to be understood that in alternate embodiments, the number of extension baffles can be one, two, three, four, six, or more. As noted above, the degree of suppression offered by the suppressor 200 can be modulated by varying the length or number of extension baffles 206. Increasing the length or number of extension baffles increases suppression, while decreasing the length or number of extension baffles decreases suppression.

Again referring to FIGS. 23A through 23H, each extension baffle 206 is a generally cylindrical body 245 having an aft end 241 and a forward end 243. Each extension baffle includes a plate 246, and a solid, generally cylindrical sidewall 248 extending normal from a circumferential edge of the plate. Solid in this context means that the sidewall 248 has no holes or apertures therethrough not filled by a bolt or other fixture. A hollow central stem 247 extends forwardly from the plate 246, parallel to the sidewall 248. The plate 246 is at the aft end 241 of the extension baffle 206, and the sidewall 248 extends forwardly from the plate 246. However, in other embodiments, the plate 246 can be positioned between the aft and forward ends 241, 243. A central hole 252 is defined through a center of the plate 246. The stem 247 extends forwardly from the circumferential edge of the central hole 252. The connecting rod 210 is receivable in the central hole 252 and through the central stem 247 to connect each extension baffle 206 to the adapter baffle 204 and barrel clamp 40*b*. The connecting rod 210 extends forward and aft through the central hole 252 and stem 247 of each extension baffle 206 when the connecting rod 210 is received in the central hole 252 and the suppressor 200 is assembled on the barrel clamp 40*b*.

A plurality of projectile apertures 254 are defined through the extension baffle plate 246. The projectile apertures 254 are radially spaced about the central hole 252 and stem 247. The projectile apertures 254 of each extension baffle longitudinally align with the projectile apertures 254 of each adjacent extension baffle 206 in the stack 202. The projectile apertures 254 of each extension baffle 206 also align with the barrels 24 when the muzzles 25 are received in the adapter baffle 204 and the extension baffles 206 are engaged with the adapter baffle 204. In this way, the barrel apertures 228 in the adapter baffle and the projectiles apertures 254 of the extension baffles 206 align to form a plurality of parallel projectile or projectile paths (i.e., bore spaces) 258 extending through the suppressor 200. The projectile paths or bore spaces 258 are radially spaced about the central holes 252 and the connecting rod 210. The number of barrel apertures 228 in the adapter baffle 204 and the number of projectile apertures 254 in the extension baffles 206 corresponds to the number of barrels 24 of the machine gun 2. Thus, the number of projectile paths 258 extending through the suppressor 200 also corresponds to the number of barrels 24 of the machine gun 2.

The plate 246 and sidewall 248 of each extension baffle 206 define a single interior cavity 250 around the central stem 247. The interior cavity 250 of the first or aftmost extension baffle 206 in the stack (i.e., adjacent the adapter baffle) is in fluid communication with the expansion space 205 of the adapter baffle 204 through the projectile apertures 254 in the plate 246. The interior cavity 250 of each subsequent extension baffle 206 is in fluid communication with each adjacent extension baffle 206 through the projectile apertures 254 in each respective baffle. The interior cavity 250 of the forwardmost or final extension baffle 206 in the stack 202 is in fluid communication with the ambient air or atmosphere outside the suppressor 200 through correspondingly aligned projectile apertures 256 in the endcap baffle 208 (discussed in more detail below). Put differently, each barrel aperture 228 of the adapter baffle 204, each projectile aperture 254 of the extension baffles 206, and each projectile aperture 256 of the endcap baffle 208 is in fluid communication with each other barrel aperture 228 or projectile aperture 254, 256 throughout the baffle stack 202. As such, each extension baffle 206 defines a single interior cavity 250 in fluid communication with the expansion space 205 of the adapter baffle 204 and the interior cavity 250 of each other extension baffle 206 through the projectile apertures 254. In this way, the adaptor baffle 204, the extension baffles 206, and the endcap baffle 208 collectively define a single continuous interior chamber 255 in which the muzzles 25 of the barrels 24 are enclosed and through which propellant gases 35 emitted from the muzzle 25 of each barrel comingle and circulate before venting to the atmosphere through the endcap baffle 208.

Figure 23E:
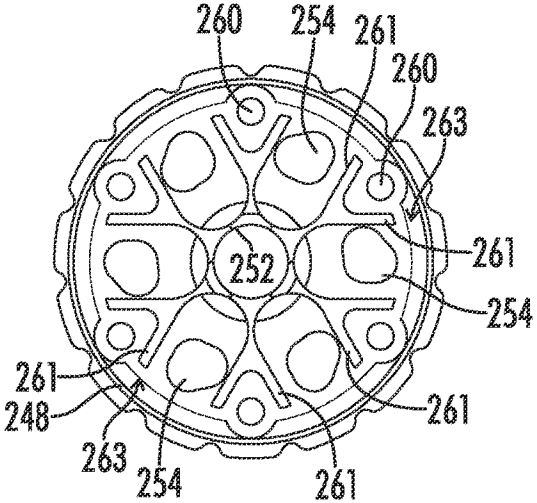
FIG. 23E is a front elevational view of the extension baffle of FIG. 23A.

Each extension baffle 206 further includes a network of vanes 261 configured to circulate propellant gasses 35 within the interior chamber 255 of the suppressor 200. The vanes 261 are formed on and extend forwardly from the forward surface of each extension baffle plate 246. The network of vanes 261 extends radially outward from the central stem 247 around the central hole 252 in each plate 246. As shown in FIG. 23E, the vanes 261 are internal walls arranged to partially laterally partition the projectile apertures 254 and projectile pathways 258. The vanes greatly increase circulation (and thus cooling and slowing) of propellant gases about the interior chamber 255 during discharge by actively mixing the gasses due to the rotation of the baffles 206 during discharge of the machine gun 2. To explain, firing the weapon generates propellant gases 35 with forward momentum. This forward momentum pushes the gases forwardly through the projectile apertures 254 of the stacked extension baffles. Firing also causes the barrels 24, the attached barrel clamp 40*b*, and the attached suppressor 200, including baffle stack 202, to rotate. Rotating the extension baffles 206 at high speed causes the vanes 261 to disrupt the forward momentum of the gasses 35 and greatly increase circulation because the vanes 261 act like fan blades by diverting the gases radially outward, perpendicular to their direction of travel and the central axis 45.

To further increase circulation of the gases around the interior chamber 255, the vanes 261 are also spaced from and do not contact the sidewall 248 of the extension baffle 206. That is, the outermost edges of the vanes 261 radially distal to the central hole 252 are spaced from and do not contact the sidewall 248 of the extension baffle 206. This leaves a gap 263 between the edges of the vanes 261 and the sidewall 248. Rotation of the extension baffles 206 and vanes 261 pushes the propellant gases radially outward against the sidewall 248 while the gasses are resident in the interior cavity 250 of each extension baffle. This in turn increases circulation along the sidewall 248, which further increases propellant gas cooling by exposing the gasses to the cooler outer walls 248 rotating rapidly in the cooler ambient air.

The sidewall 224, 248, 266 of each baffle in the baffle stack 202 (i.e., the adapter 204, extension 206 and endcap 208 baffles, respectively) is configured to maximize air induction and heat dissipation. In one embodiment, a plurality of parallel fins 268 configured to increase suppressor surface area and heat dissipation can be formed on the exterior surface 224*a*, 248*a*, 266*a* of each baffle sidewall 224, 248, 266, respectively. The fins 268 can extend longitudinally along the exterior surface 224*a*, 248*a*, 266*a* of each baffle sidewall 224, 248, 266. The fins 268 can extend parallel to the central axis 45 and perpendicular to the direction of suppressor 200 rotation during firing. Each fin 268 can be spaced from the exterior surface 224*a*, 248*a*, 266*a* of the baffle sidewall so as to form against the exterior surface 224*a*, 248*a*, 266*a* a conduit 270 through which ambient air is flowable to cool the baffle sidewall 224, 248, 266. The fins 268 create turbulence in the ambient air as the suppressor 200 rotates and thereby cools the exterior surface of each baffle 204, 206, 208 in the stack 202.

Each extension baffle 206 can also include a plurality of overpressure apertures 260 extending through the plate 246. The overpressure apertures 260 can be spaced radially outward and equidistant from the central hole 252. The overpressure apertures 260 can be defined through a peripheral portion 264 of the extension baffle plate 246 located more radially distal from the central hole 252 than the projectile apertures 254. Each overpressure aperture 260 can be disposed between and spaced from a pair of adjacent projectile apertures 254. The overpressures apertures 260 of each extension baffle 206 can longitudinally align with the overpressure apertures 260 of every other extension baffle 206 in the baffle stack 202. Each overpressure aperture 260 can be located partially or wholly in the gap 263 between the sidewall 248 and the vanes 261. This promotes rapid mixing and cooling of propellant gases as they pass along the interior surface of the outer walls 248 of the suppressor (i.e., the interior surface of the extension baffle sidewalls). Rapid venting to the atmosphere of overpressure gasses resulting from sustained fire is achieved via overpressure apertures 262 in the endcap baffle 208. The overpressure apertures 262 in the endcap baffle 208 are longitudinally aligned with the plurality of overpressure apertures 260 in the extension baffles 206. The aligned overpressure apertures 260 of the extension baffles 206 and the overpressure apertures 262 of the endcap baffle 208 define a plurality of overpressure pathways 265 extending through the suppressor parallel to and radially spaced from the central axis 45. The overpressure pathways 265 are also spaced from and parallel to the projectile pathways 258.

Figure 24:
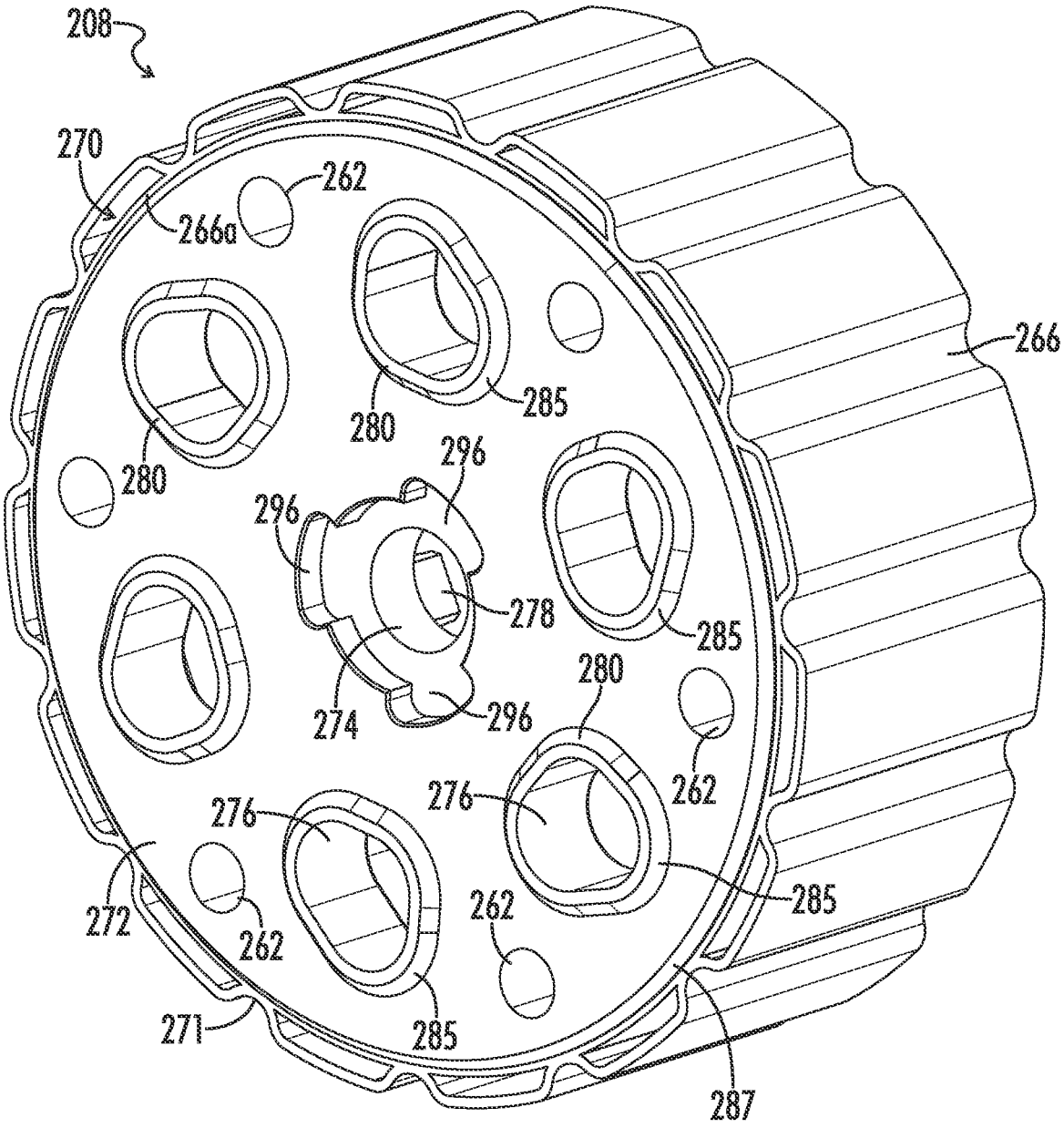
FIG. 24 is a rear elevational view of the endcap baffle of the suppressor of FIG. 11B.

As noted above, the forwardmost or last baffle in the baffle stack 202 is the endcap baffle 208. The endcap baffle 208 engages and is aligned with the forwardmost or final extension baffle 206 in the stack 202. As best shown in FIG. 24, the endcap baffle 208 includes a plate 272 through which is defined a central hole 274 and plurality of projectile apertures 276. The central hole 274 of the endcap baffle 208 aligns with the central holes 252 of each extension baffle 206 and the adapter baffle stem 230. The plurality of projectile apertures 276 in the endcap baffle 208 align with the plurality of projectile apertures 258 in the extension baffles 206. The forward surface 273 of the plate 272 can include one or more protrusions 278 that define a cavity or space 277 around the central hole 274 in which the head 221 of the second threaded fastener 214 is received and captured (i.e., prevented from rotating relative to the endcap baffle) when the fastener 214 is received in the central hole 274 and engaged with the connecting rod 210 (see FIGS. 14 and 16).

The endcap 208 baffle also includes a sidewall 266 that extends forwardly from the plate 272. The endcap baffle sidewall 266 functions as a "blast cone" or flash hider which hides any remaining flash that may exit the suppressor, even during sustained fire. The blast cone 266 protects the forward end of the suppressor 200 during transport and use by preventing the projectile apertures 276 and overpressure apertures 262 from becoming blocked or clogged by foreign objects such as packing material or mud and dirt. The blast cone 266 further protects the endcap baffle 208 from damage resulting from accidental or unexpected percussive forces that may be encountered during transport, installation, or use.

Referring now to FIGS. 14, 21C, and 23A-23F, suppressors of the present invention are specifically designed to overcome certain complications arising from rotation of the suppressor with the barrel cluster so that the suppressor can function with both supersonic and subsonic ammunition. To explain, the use of subsonic ammunition can be preferred over faster supersonic ammunition in applications requiring stealth because the discharge of subsonic ammunition creates a quieter report. However, the high speed at which the barrel cluster 6 of a conventional M134 rotary machine gun rotates (e.g., about 500 revolutions per minute when the weapon is set to fire at its slowest setting of about 3000 rounds per minute) creates a risk that a slower traveling subsonic projectile could impact a rotating baffle plate as the projectile travels along a projectile pathway 258 though the suppressor because slower subsonic ammunition requires a few hundred milliseconds more than supersonic ammunition to travel the length of a suppresser disclosed herein. Therefore, to prevent a rotating baffle plate from occluding a projectile pathway 258 and thereby eliminate the risk of associated malfunction and injury, projectile apertures formed in some embodiments of baffles for the suppressor disclosed herein are noncircular in shape.

More specifically, the projectile apertures 254, 276 of certain embodiments of extension 206 and endcap 208 baffles are elongated (i.e., widened) in a direction counter to the direction of rotation of the barrel cluster 6 during use. In some embodiments, the projectile apertures 254, 276 are also elongated in a direction extending toward the central axis 45. Noncircular projectile apertures 254, 276 elongated in a direction counter to the direction of rotation and in a direction extending toward the central axis 45 account for the slower speed and different trajectory of subsonic ammunition by enlarging each projectile aperture 254, 276 in two directions that would not otherwise be needed for relatively faster, flatter-shooting supersonic ammunition.

Figure 23C:
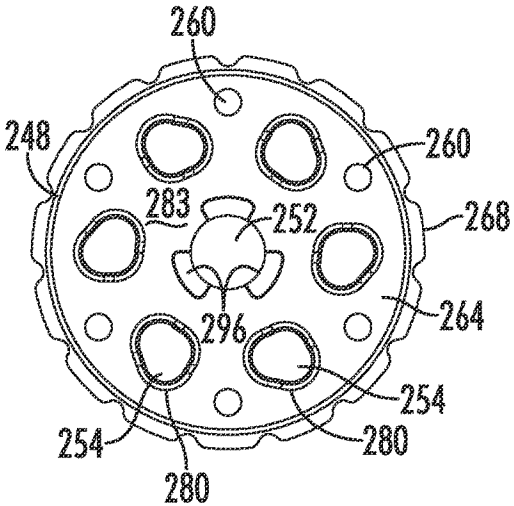
FIG. 23C is a rear elevational view of the extension baffle of FIG. 23A.
Figure 23F:
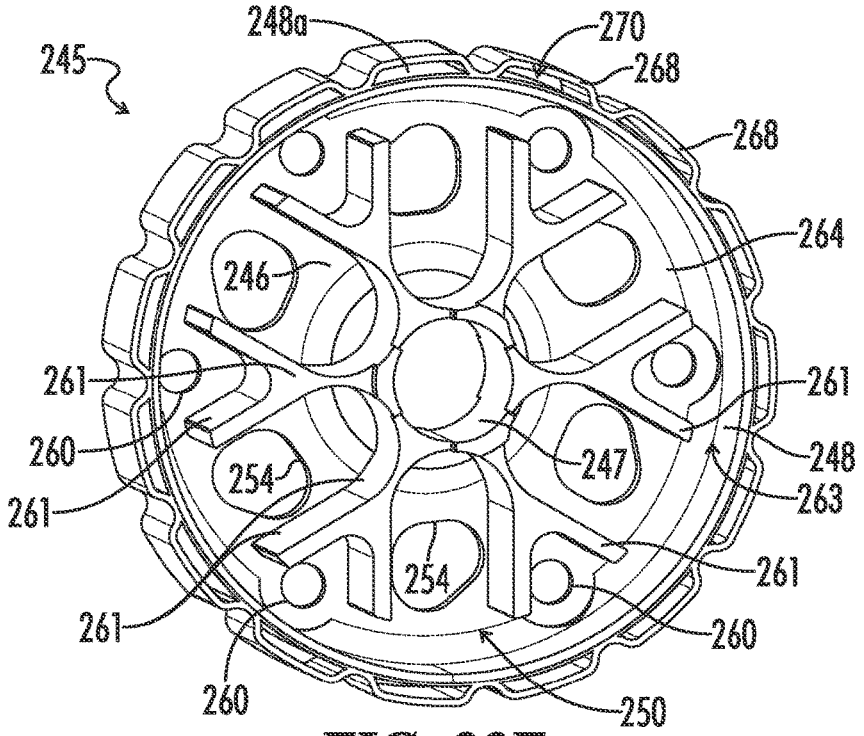
FIG. 23F is another elevated front isometric view of the extension baffle of FIG. 23A.
Figure 23G:
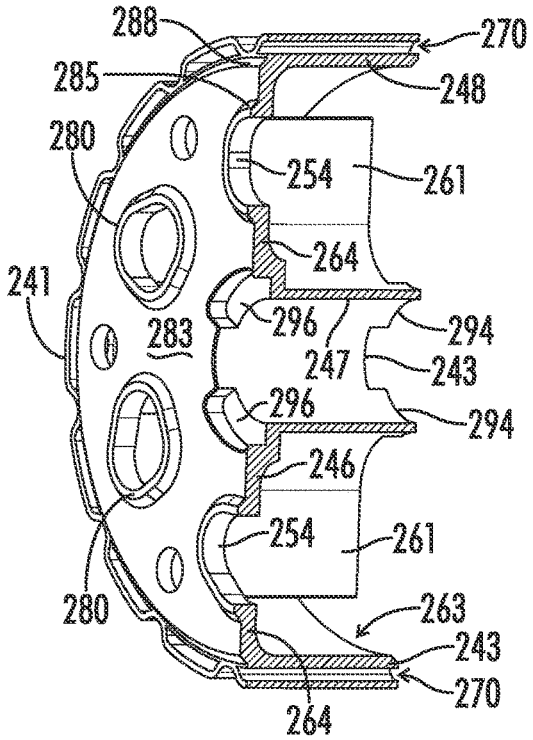
FIG. 23G is a rear isometric sectional view taken along line 23-23 of FIG. 23D.
Figure 23H:
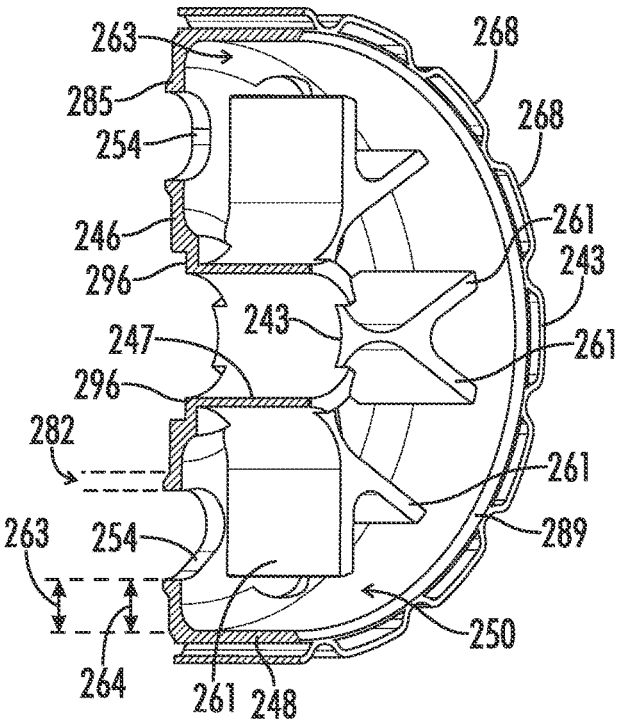
FIG. 23H is a front isometric sectional view taken along line 23-23 of FIG. 23D.

As best exemplified in FIGS. 23C and 23E, projectile apertures 254, 276 in the adapter and extension baffles can have a generally triangular shape. The triangular shape permits slower subsonic ammunition to exit the barrel muzzles 25 and the endcap baffle 208 without striking a baffle plate 246, 272 along the projectile path 258 by widening the projectile aperture 254, 276 though each extension and endcap baffle 206, 208, respectively, to account for both projectile drop and rotation of the suppressor 200 relative to the projectile. As such, the projectile apertures 254, 276 formed in the extension baffles 206 and endcap baffle 208 are shaped so as to account for the relative differences in speed, travel time, and trajectory required for subsonic and supersonic projectiles to exit a rotating suppressor disclosed herein.

Additional complications resulting from rotation of the suppressor include baffle erosion. Baffle erosion is caused by hot propellant gases and particulate matter that follow a projectile through the aligned projectile apertures 254, 276 in each baffle plate 246, 272 along a projectile path 258 each time a round is fired. The hot gases and particulate matter spread radially outwardly from the projectile path 258 and impact the rear facing surface (i.e., the surface facing the machine gun rotor) of each rotating baffle plate 246, 272 around the margin of each projectile aperture 254, 276 at very high speeds. Over time, this can erode material from the baffle plates around the projectile apertures and limit the service life and sound damping capabilities of each baffle, and by extension, the assembled suppressor. Therefore, to limit the effect of erosion and dramatically extend the service life of each baffle and the assembled suppressor, the plate 246, 272 of each extension baffle 206 and the endcap baffle 208 can include a rearwardly protruding lip 280 formed around the margin of each respective projectile aperture 254, 276.

As exemplified in FIGS. 13, 17- 18, 21A, 23A, and 23G, in some embodiments, each lip 280 has a width 282 and protrudes rearwardly a distance 284 or length from the aft surface 283 of the associated baffle plate 246, 272, respectively. The lips 280 greatly increase the service life of each baffle and thus the assembled suppressor by providing more material for hot propellant gases and particular matter to erode during firing before erosion renders a given baffle and thus the suppressor ineffective or inoperable.

In addition, the exterior circumferential surface 285 of each lip (i.e., the surface facing away from the aperture) can be sloped or angled relative to the surrounding aft surface 283 of the respective baffle plate 246, 272. The angled lip surface 285 creates additional turbulence among propellant gases and thereby increases circulation of such gases within the interior chamber 255 of the suppressor 200 by diverting a portion of the gases away from the projectile aperture 254, 276 at each baffle plate 246, 272. This cycles propellant gases radially outward from each projectile aperture 254, 276 inside the interior cavity 250 of each extension baffle and toward the gap 263 between each network of vanes 261 and the sidewall 248 as the gases move forward through each baffle in the baffle stack 202. This slows and cools the gasses as explained above, which in turn significantly reduces or eliminates any visible flash once the gasses finally exit the interior chamber 255 through the projectile apertures 276 in the endcap baffle 208.

As noted above, the suppressors disclosed herein rotate with the barrel clamp and barrels about the central axis 5, 45 during firing of the machine gun. In some embodiments, rotary motion of the baffles 202 is achieved by a series of interlocking connections between each baffle in the baffle stack 202. As best shown in FIGS. 15 through 19B, the barrel clamp 40*b* is configured to interlock with and transfer rotary motion to the adapter baffle 204. The adapter baffle 204 is configured to interlock with and transfer rotary motion to the first (i.e., aft) extension baffle 206. Each extension baffle 206 is configured to interlock with and transfer rotary motion to each subsequent extension baffle 206 in the stack and the endcap baffle 208.

More specifically, the forward end 48 of the barrel clamp shaft 46 defines three slots 290. The aft end 218 of the adapter baffle 204 defines a circular protrusion 291 with three clamp lugs 292 extending radially outward therefrom. The circular protrusion 291 is received inside the hollow forward end 48 of the barrel clamp shaft 46, and the clamp lugs 292 are received in the three slots 290. The forward end 220 of the adapter baffle central stem 230 defines three baffle lugs 294 (see FIGS. 23A-2311). The forward end 243 of each extension baffle stem 247 also defines three baffle lugs 294 (see FIGS. 22A-22F). The aft end 241 of each extension baffle 206 defines three baffle lug receptables 296 in which the baffle lugs 294 of either the adapter baffle 204 or another extension baffle 206 are received. The aft end 271 of the endcap baffle 208 is identical to the aft end 241 of each extension baffle 206. As such, the aft end 271 of the endcap baffle 208 also defines three baffle lug receptables 296 in which the baffle lugs 294 of the forwardmost or final extension baffle 206 in the stack 202 are received.

The clamp 292 lugs on the adaptor baffle 204 engage and interlock with the slots 290 of the barrel clamp 40*b* so that the barrel clamp 40*b* transfers rotary motion to the adaptor baffle 204. The baffle lugs 294 on the adaptor baffle 204 engage and interlock with the baffle lug receptacles 296 on the aft extension baffle 206 and transfer rotary motion from the adaptor baffle 204 to the aft extension baffle 206. The baffle lugs 294 on the aft extension baffle 206 engage and interlock with the baffle lug receptacles 296 on the adjacent extension baffle 206 and transfer rotary motion from the aft extension baffle to the adjacent extension baffle. The baffle lugs 294 on each extension baffle 206 engage and interlock with the baffle lug receptacles 296 on each respective adjacent extension baffle 206 and transfer rotary motion from each extension baffle 206 to the respective subsequent adjacent extension baffle 206. The baffle lugs 294 on the forward or final extension baffle engage 206 and interlock with the baffle lug receptacles 296 on the endcap baffle 208 and transfer rotary motion from the final extension baffle 206 to the endcap baffle 208. In this way, rotary motion is transferred from the barrel clamp 40*b* to each baffle in the baffle stack 202.

The foregoing series of interlocking connections between each baffle in the baffle stack 202 and the barrel clamp 40*b* also advantageously provide an alignment mechanism by keying the clamp lugs 292, slots 290, baffle lugs 294, and lug receptacles 296 to the barrel apertures 228 and projectile apertures 254, 276 of each respective baffle. This simultaneously prevents a user from incorrectly assembling the suppressor and aligns the barrel apertures 228 of the adapter baffle 204 with the projectile apertures 254, 276 of the extension baffles 206 and endcap baffle 208, respectively.

Referring now to FIGS. 16-19B and 22A though 2311, the forward and aft end of each baffle in the stack 202 is configured to form a gas-tight seal and self-center during assembly. To this end, the adapter baffle 204 includes an internally chamfered (i.e., female) forward edge 286. The endcap baffle 208 includes an externally chamfered (i.e., male) aft edge 287. Each extension baffle 206 includes an externally chamfered (i.e., male) aft edge 288 receivable in the internally chamfered forward edge 286 of the adapter baffle 204. Each extension baffle 206 also includes an internally chamfered (i.e., female) forward edge 289 in which the externally chamfered aft edge 287 of the endcap baffle 208 is receivable. The internally chamfered forward edge 286 of the adapter baffle 204 receives and matingly engages the externally chamfered aft edge 287 of the aft extension baffle 206. The internally chamfered forward edges 289 of the aft extension baffle and each subsequent extension baffle in the stack receives and matingly engages the externally chamfered aft edge 288 of each subsequent extension baffle. The internally chamfered forward edge 289 of the forward or final extension baffle in the stack receives and matingly engages the externally chamfered aft edge 287 of the endcap baffle 208. This combination of interlocking male and female chamfers makes the baffles self-centering during assembly, and creates a high-pressure gas tight seal between the baffles when they are compressively secured in a stack 202 on the barrel clamp 210 by the connecting rod 40*b*.

In use, a suppressor disclosed herein can be assembled and mounted to a rotary machine gun as follows. The connecting rod 210 is inserted through the endcap baffle 208. The second threaded fastener 214 is inserted through the central hole 274 in the endcap baffle 208 and threaded into the forward end 213 of the connecting rod 210 such that the head 221 of the fastener 214 is captured in the cavity 277 and the endcap baffle 208 is secured to the forward end 213 of the connecting rod 210. The aft end of the connecting rod 210 is then inserted through the central hole 252 of one or more extension baffles 206 with each extension baffle 206 oriented such that its front end 243 faces the endcap baffle 208. Rotating each extension baffle 206 slightly as it is placed in contact with the endcap baffle 208 or another extension baffle 206 will ensure interlocking engagement between adjacent baffle lugs 294 and baffle lug receptacles 296. The aft end 211 of the connecting rod 210 is then inserted through the central hole 226 of the adapter baffle 204. Rotating the adapter baffle 204 slightly as it is placed in contact with the aft extension baffle 206 will ensure interlocking engagement between the baffle lugs 294 of the adapter baffle 204 and the baffle lug receptacles 296 of the aft extension baffle 206. The connecting rod 210 is inserted through the forward end 48 of the barrel clamp shaft 46. Rotating the barrel clamp 40*b* slightly as it is placed in contact with the adapter baffle 204 will ensure receipt of the circular protrusion 291 in the forward end 48 of the barrel clamp shaft 46 and interlocking engagement between the barrel clamp lugs 292 and the slots 292. The aft end 211 of the connecting rod 214 is then secured to the aft end 44 of the barrel clamp 40*b* by the flanged hex head eye bolt 212.

The assembled suppressor 200 is then mounted to the barrel cluster 6 of the machine gun 2*b* by inserting the muzzles 25 of the barrels 24 through the barrel apertures 52 of the barrel clamp cup 42 and into the barrel apertures 228 of the adapter baffle 204. The barrel clamp cup 42 is placed around the barrel lugs 60, and the cross bolt 56 is inserted laterally between the barrels 24, through the holes 43 in the cup 42, and the eye 219 of the flanged hex head eye bolt 212 such that the threaded end of the cross bolt 56 protrudes out of the opposite side of the cup 42 from the cross bolt head. A nut 62 is threaded onto the threaded end of the cross bolt 56 to secure the suppressor 200 to the barrel cluster 6.

Although embodiments of the present invention have been described in detail, it will be understood by those skilled in the art that various modifications can be made therein without departing from the spirit and scope of the invention as set forth in the appended claims For example, suppressors of the present invention can be configured to mount to multi-barrel weapon systems other than rotary machine guns, including, for example, double barrel shotguns and the like. In such embodiments, the barrel clamp 40 may be omitted and a different mechanism used to attached the baffle stack to the weapon barrels.

Additionally, in some embodiments, an adapter baffle can be secured to the forward end of a barrel clamp by a welded joint. In such embodiments, the one or more extension baffles and endcap baffle may likewise be secured to the adapter baffle and to each other using weld joints between the baffles.

In other embodiments, the one or more extension baffles and the endcap baffle may be secured to the adapter baffle and to each other using threaded connections between the baffles. Preferably, when threaded connections are used between the baffles, the projectile apertures in the baffles are properly aligned when the baffles are fully threaded together in order to form the bore spaces for each barrel. When the baffles are secured using either weld joints or threaded connections, the connecting rod may be omitted.

Each of the baffles disclosed herein can be fabricated using a single pipe. Plates having a forward and rear face can be positioned at various distances along the length of the pipe. The forward and rear surfaces of the plate run perpendicular a central axis of the pipe. An outer edge of the plate contacts the interior surface of the pipe around the perimeter of the plate and is secured within the pipe. The rear end of the pipe is secured to the forward end of the barrel clamp with a weld joint. An endcap baffle is formed by securing a plate to the forward end of the pipe. The plates may be fabricated with projectile apertures or overpressure apertures as described above. The plates may be secured to the pipe with weld joints. In other embodiments, each of the baffles disclosed herein can be machined or extruded from a single piece of steel or other suitably durable metal or synthetic material.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific apparatus and methods described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims Thus, although there have been described particular embodiments of the present invention, it is not intended that such references be construed as limitations upon the scope of this invention except as set forth in the following claims.

What is claimed is:

1. A suppressor for a rotary machine gun having a plurality of barrels, the suppressor comprising:

a barrel clamp configured to support the plurality of barrels, the barrel clamp defining a central axis about which the plurality of barrels rotates with the barrel clamp during discharge of the machine gun when the plurality of barrels is supported by the barrel clamp;

an adapter baffle engaging the barrel clamp and configured to receive a muzzle of each barrel of the plurality of barrels when the plurality of barrels is supported by the barrel clamp;

a plurality of extension baffles aligned with and arranged in a stack on the adaptor baffle, each extension baffle comprising a plate, a sidewall extending from the plate, and a plurality of projectile apertures defined through the plate, wherein the plurality of projectile apertures of each extension baffle are configured to align with the plurality of projectile apertures of each adjacent extension baffle and the plurality of barrels when the muzzles are received in the adapter baffle; and an endcap baffle aligned with the plurality of extension baffles and engaging a final extension baffle of the stack, the endcap baffle comprising a plate through which is defined a plurality of projectile apertures that are aligned with the plurality of projectile apertures of each extension baffle;

wherein the adapter baffle, the plurality of extension baffles, and the endcap baffle collectively define a single interior chamber of the suppressor in which propellant gases emitted from the muzzle of each barrel of the plurality of barrels comingle and circulate before venting to the atmosphere through the endcap baffle.

2. The suppressor of claim 1, wherein the adapter baffle, the plurality of extension baffles, and endcap baffle are configured to rotate with the barrel clamp and the plurality of barrels about the central axis during discharge of the machine gun.

3. The suppressor of claim 1, further comprising a connecting rod compressively securing the adapter baffle, the plurality of extension baffles, and the endcap baffle to the barrel clamp, the connecting rod extending through the barrel clamp, the adapter baffle, the plurality of extension baffles, and the endcap baffle along the central axis.

4. The suppressor of claim 1, wherein:

each extension baffle includes a plurality of vanes formed on the plate thereof, the plurality of vanes configured to circulate propellant gasses emitted from the muzzle of each barrel of the plurality of barrels within an interior space at least partially defined by the sidewall of the extension baffle; and the plurality of vanes is spaced from and does not contact the sidewall of the extension baffle.

5. A suppressor for a rotary machine gun having a plurality of barrels supported by a barrel clamp that defines a central axis about which the plurality of barrels and the barrel clamp rotate during discharge of the rotary machine gun, the suppressor comprising:

an adapter baffle configured to engage the barrel clamp and receive a muzzle of each barrel of the plurality of barrels when the adapter baffle is engaged with the barrel clamp;

at least one extension baffle configured to engage the adapter baffle such that the at least one extension baffle is aligned with the adapter baffle, the at least one extension baffle comprising a sidewall and a plate through which is defined a plurality of projectile apertures that are configured to align with the plurality of barrels when the at least one extension baffle is engaged with the adapter baffle and the adapter baffle is engaged with the barrel clamp; and an endcap baffle configured to engage the at least one extension baffle such that the endcap baffle is aligned with the at least one extension baffle, the endcap baffle comprising a plate through which is defined a plurality of projectile apertures that are configured to align with the plurality of projectile apertures in the at least one extension baffle when the endcap baffle is engaged with the at least one extension baffle;

wherein each projectile aperture is in fluid communication with each other projectile aperture when the adapter baffle is engaged with the barrel clamp, the at least one extension baffle is engaged with the adapter baffle, and the endcap baffle is engaged with the at least one extension baffle.

6. The suppressor of claim 5, wherein the adapter baffle comprises a plate defining a plurality of barrel apertures in which the plurality of barrels is receivable.

7. The suppressor of claim 6, wherein:

the adapter baffle comprises a sidewall extending from the plate; and the sidewall is configured to surround and extend beyond the muzzle of each barrel of the plurality of barrels when the plurality of barrels is received in the plurality of barrel apertures.

8. The suppressor of claim 6, wherein:

the adapter baffle comprises a sidewall extending from the plate; and the sidewall defines an expansion space in which propellant gases emitted from each muzzle comingle during discharge of the machine gun.

9. The suppressor of claim 7, wherein the muzzles of the plurality of barrels are received in the adapter baffle when the plurality of barrels is received in the plurality of barrel apertures such that the muzzle of each barrel of the plurality of barrels is longitudinally disposed between the plate of the adapter baffle and a forward end of the sidewall of the adapter baffle.

10. The suppressor of claim 5, wherein the adapter baffle, the at least one extension baffle, and the endcap baffle define a single continuous interior chamber in which the muzzle of each barrel of the plurality of barrels is enclosed and through which propellant gases emitted from the muzzles comingle before venting to the atmosphere through the endcap baffle when the at least one extension baffle is engaged with the adapter baffle and the endcap baffle is engaged with the at least one extension baffle.

11. The suppressor of claim 5, wherein the adapter baffle, the at least one extension baffle, and the endcap baffle are configured to rotate with the barrel clamp and the plurality of barrels about the central axis during discharge of the machine gun when the adapter baffle is engaged with the barrel clamp, the at least one extension baffle is engaged with the adapter baffle, and the endcap baffle is engaged with the at least one extension baffle.

12. The suppressor of claim 5, wherein:

the adapter baffle is configured to interlock with the barrel clamp and the at least one extension baffle when the adaptor baffle is engaged with the barrel clamp and the at least one extension baffle is engaged with the adaptor baffle; and the endcap baffle is configured to interlock with the at least one extension baffle when the at least one extension baffle is engaged with the adaptor baffle and the endcap baffle is engaged with the at least one extension baffle;

whereby rotary motion is transferred from the barrel clamp to the adaptor baffle, the at least one extension baffle, and the endcap baffle.

13. The suppressor of claim 5, wherein:

the barrel clamp includes a forward end defining a plurality of slots;

the adapter baffle includes an aft end defining a plurality of clamp lugs, and a forward end defining a plurality of baffle lugs;

the at least one extension baffle includes an aft end defining a plurality of baffle lug receptacles, and a forward end defining a plurality of baffle lugs;

the endcap baffle includes an aft end defining a plurality of baffle lug receptacles;

the plurality of clamp lugs on the adaptor baffle is configured to interlock with the plurality of slots of the barrel clamp and transfer rotary motion from the barrel clamp to the adaptor baffle when the adaptor baffle engages the barrel clamp;

the plurality of baffle lugs on the adaptor baffle are configured to interlock with the plurality of baffle lug receptacles on the at least one extension baffle and transfer rotary motion from the adaptor baffle to the at least one extension baffle when the at least one extension baffle engages the adaptor baffle; and the plurality of baffle lugs on the at least one extension baffle is configured to interlock with the plurality of baffle lug receptacles on the endcap baffle and transfer rotary motion from the at least one extension baffle to the endcap baffle when the endcap baffle engages the at least one extension baffle.

14. The suppressor of claim 5, wherein the at least one extension baffle includes a plurality of vanes formed on the plate thereof, the plurality of vanes configured to circulate propellant gasses emitted from the muzzle of each barrel of the plurality of barrels within an interior space at least partially defined by the sidewall of the at least one extension baffle.

15. The suppressor of claim 14, wherein the plurality of vanes is spaced from and does not contact the sidewall of the at least one extension baffle.

16. The suppressor of claim 15, wherein:

the extension baffle plate defines a plurality of overpressure apertures extending through and radially spaced around a periphery of the extension baffle plate, each of said overpressure apertures located at least partially in a gap between said vanes and the sidewall; and the endcap baffle plate defines a plurality of vent apertures that aligns with the plurality of overpressure apertures in the extension baffle plate when the endcap baffle is engaged with the extension baffle.

17. The suppressor of claim 5, further comprising:

a connecting rod configured to compressively secure the adapter baffle, the at least one extension baffle, and the endcap baffle to the barrel clamp with the adapter baffle engaging the barrel clamp, the at least one extension baffle engaging the adapter baffle, and the endcap baffle engaging the at least one extension baffle;

wherein each of the adapter baffle, the at least one extension baffle, and the endcap baffle are configured to receive the connecting rod therethrough.

18. The suppressor of claim 5, further comprising:

a connecting rod having an aft end and a forward end;

a first threaded fastener; and a second threaded fastener; wherein:

the adaptor baffle includes a plate defining a central hole;

the plate of the at least one extension baffle defines a central hole;

the plate of the endcap baffle defines a central hole;

the connecting rod is receivable through the barrel clamp and the respective central hole of each of the adapter baffle, the at least one extension baffle, and the endcap baffle;

the first threaded fastener is engageable with the aft end of the connecting rod when the connecting rod is received through the barrel clamp to secure the aft end of the connecting rod to the barrel clamp; and the second threaded fastener is engageable with the forward end of the connecting rod when the aft end of the connecting rod is secured to the barrel clamp and the connecting rod is received through the respective central hole of each of the adapter baffle, the at least one extension baffle, and the endcap baffle to compressively secure the adapter baffle, the at least one extension baffle, and the endcap baffle to the barrel clamp.

19. The suppressor of claim 5, wherein the at least one extension baffle is a plurality of substantially identical extension baffles, each of which is configured to align with and engage either of the adapter baffle or another extension baffle of the plurality such that said extension baffles are stackable in series against either the adaptor baffle or the endcap baffle.

20. The suppressor of claim 19, wherein:

the adapter baffle defines a single interior expansion space in which the muzzles of the plurality of barrels are receivable when the adapter baffle is engaged with the barrel clamp; and each extension baffle defines a single interior cavity in fluid communication with the expansion space and the interior cavity of each adjacent extension baffle when the adapter baffle is engaged with the barrel clamp, the plurality of extension baffles are stacked in series on the adapter baffle, and the endcap baffle is engaged with the final extension baffle in the stack such that that adaptor baffle, the plurality of extension baffles, and the endcap baffle collectively define a single continuous interior chamber in which propellant gases emitted from the muzzle of each barrel of the plurality of barrels comingle and circulate before venting to the atmosphere through the endcap baffle.

21. The suppressor of claim 5, wherein:

the adapter baffle includes an internally chamfered forward edge;

the endcap baffle includes an externally chamfered aft edge;

the at least one extension baffle includes an externally chamfered aft edge and an internally chamfered forward edge;

the externally chamfered aft edge of the at least one extension baffle is configured to matingly engage the internally chamfered forward edge of the adapter baffle when the at least one extension baffle is engaged with the adapter baffle; and the externally chamfered aft edge of the endcap baffle is configured to matingly engage the internally chamfered forward edge of the at least one extension baffle when the endcap baffle is engaged with the at least one extension baffle.

22. The suppressor of claim 5, wherein each projectile aperture in the at least one extension baffle and the endcap baffle is noncircular.

23. The suppressor of claim 5, wherein:

the endcap baffle includes a lip protruding rearwardly from around a margin of each projectile aperture defined in the plate of the endcap baffle;

the at least one extension baffle includes a lip protruding rearwardly from around a margin of each projectile aperture defined in the plate of the at least one extension baffle.

24. The suppressor of claim 5, wherein at least one of the adapter baffle, the at least one extension baffle, and endcap baffle comprises a plurality of fins on an outer surface thereof.

25. A suppressed rotary machine gun, comprising:

a rotor;

a plurality of barrels connected to the rotor, each barrel of the plurality having a muzzle;

a barrel clamp secured to the plurality of barrels and defining a central axis about which the barrel clamp rotates with the plurality of barrels during discharge of the rotary machine gun;

an adapter baffle engaging the barrel clamp and configured to surround the muzzle of each barrel of the plurality of barrels, the adapter baffle comprising a plate through which is defined a plurality of barrel apertures in which the plurality of barrels is received;

an aft extension baffle engaging and aligned with the adapter baffle, the aft extension baffle comprising a sidewall and a plate through which is defined a plurality of projectile apertures aligned with the plurality of barrels;

a forward extension baffle engaging and aligned with the aft extension baffle, the forward extension baffle comprising a sidewall and a plate through which is defined a plurality of projectile apertures aligned with the plurality of projectile apertures in the aft extension baffle; and an endcap baffle engaging and aligned with the forward extension baffle, the endcap baffle comprising a plate through which is defined a plurality of projectile apertures aligned with the plurality of projectile apertures in the forward extension baffle;

wherein the adaptor baffle, the aft extension baffle, the forward extension baffle, and the endcap baffle collectively define a single continuous interior chamber in which propellant gases emitted from the muzzle of each barrel of the plurality of barrels comingle and circulate before venting to the atmosphere through the endcap baffle.

26. The suppressed rotary machine gun of 25, further comprising:

a connecting rod having an aft end and a forward end, the connecting rod compressively securing the adapter baffle, the aft extension baffle, the forward extension baffle, and the endcap baffle to the barrel clamp;

a first threaded fastener securing the aft end of the connecting rod to the barrel clamp; and a second threaded fastener securing the forward end of the connecting rod to the endcap baffle;

wherein the adapter baffle, the aft extension baffle, the forward extension baffle, and the endcap baffle rotate with the barrel clamp and the plurality of barrels about the central axis during discharge of the rotary machine gun.

27. A suppressor for a weapon system having a plurality of barrels, the suppressor comprising:

an adapter baffle configured to receive a muzzle of each barrel of the plurality of barrels when the adapter baffle is engaged with the weapon system;

at least one extension baffle configured to engage the adapter baffle such that the at least one extension baffle is aligned with the adapter baffle, the at least one extension baffle comprising a sidewall and a plate through which is defined a plurality of projectile apertures that are configured to align with the plurality of barrels when the at least one extension baffle is engaged with the adapter baffle and the adapter baffle is engaged with the weapon system; and an endcap baffle configured to engage the at least one extension baffle such that the endcap baffle is aligned with the at least one extension baffle, the endcap baffle comprising a plate through which is defined a plurality of projectile apertures that are configured to align with the plurality of projectile apertures in the at least one extension baffle when the endcap baffle is engaged with the at least one extension baffle;

wherein when the adapter baffle is engaged with the weapon system, the at least one extension baffle is engaged with the adaptor baffle, and the endcap baffle is engaged with the at least one extension baffle, the adaptor baffle, the at least one extension baffle, and the endcap baffle collectively define a single continuous interior chamber in which propellant gases emitted from the muzzle of each barrel of the plurality of barrels comingle and circulate before venting to the atmosphere through the endcap baffle.

* * * * *